US011927004B2

(12) United States Patent
Tanimoto et al.

(10) Patent No.: US 11,927,004 B2
(45) Date of Patent: Mar. 12, 2024

(54) FLUSH WATER TANK DEVICE AND FLUSH TOILET APPARATUS PROVIDED WITH THE SAME

(71) Applicant: TOTO LTD., Kitakyushu (JP)

(72) Inventors: Hideki Tanimoto, Kitakyushu (JP); Koki Shinohara, Kitakyushu (JP); Kenji Hatama, Kitakyushu (JP); Makoto Abe, Kitakyushu (JP); Seika Tatsuoka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 19 days.

(21) Appl. No.: 17/822,621

(22) Filed: Aug. 26, 2022

(65) Prior Publication Data

US 2023/0069634 A1 Mar. 2, 2023

(30) Foreign Application Priority Data

Aug. 27, 2021 (JP) ..... 2021-139357

(51) Int. Cl.
*E03D 1/34* (2006.01)
*E03D 3/02* (2006.01)

(52) U.S. Cl.
CPC ..... *E03D 1/34* (2013.01); *E03D 3/02* (2013.01)

(58) Field of Classification Search
CPC .... E03D 1/34; E03D 1/35; E03D 1/36; E03D 3/02
USPC ..... 4/374, 378–379, 388, 405, 422, 425
See application file for complete search history.

(56) References Cited

U.S. PATENT DOCUMENTS

2021/0040717 A1* 2/2021 Kitaura ..... E03D 1/34
2021/0040718 A1* 2/2021 Kitaura ..... E03D 1/34
2021/0270023 A1* 9/2021 Kitaura ..... E03D 1/34

FOREIGN PATENT DOCUMENTS

JP H06-146365 A 5/1994

* cited by examiner

*Primary Examiner* — Tuan N Nguyen
(74) *Attorney, Agent, or Firm* — Studebaker & Brackett PC

(57) ABSTRACT

The present invention provides a flush water tank device (4) that supplies flush water to an upper and lower spout port of a flush toilet (2) including; a flush water tank (10); a discharge valve (12); a first on-off valve (19) that performs switching between ejection and stopping of the flush water from the upper spout port; a first on-off valve driving mechanism (16) that is moved from a stopped position to an ejection position based on an user operation; a biasing mechanism (17) that causes the first on-off valve driving mechanism to move to the stopped position; a holding mechanism (20) that holds, at the ejection position, the first on-off valve driving mechanism at the ejection position against the bias force; and a releasing mechanism (21) that releases the holding of the first on-off valve driving mechanism, using the flush water flowing out from the first on-off valve.

11 Claims, 12 Drawing Sheets

FLUSH WATER TANK DEVICE AND FLUSH TOILET APPARATUS PROVIDED WITH THE SAME

BACKGROUND OF THE INVENTION

Field of the Invention

The present invention relates to a flush water tank device and particularly to a flush water tank device for supplying flush water to an upper spout port above a retained water surface in a flush toilet main body and a lower spout port below the retained water surface and a flush toilet apparatus provided with the same.

Description of the Related Art

Japanese Patent Laid-Open No. 6-146365 (Patent Document 1) describes a toilet washing tank device. According to the toilet washing tank device, a lever member is pressed down through rotation of a lever handle, and as a result, a selector valve is switched to a rim water passage side, and a water supply valve is opened. In this manner, ejection of flush water, which has been supplied from a water supply source such as tap water, from a rim water passage portion is started. Here, a float is attached to a distal end of the lever member, and a force pushing up the lever member acts on the lever member due to a buoyant force acting on the float. However, a state where the lever member is pushed down is held by engagement between a rotary pushing portion and the lever member included in the toilet washing tank device.

Furthermore, a reservoir tank is provided with a delayed valve opening-type water discharge means, and flush water in the reservoir tank is drained to a jet water conduit with delay after water ejection from the rim water passage portion is started. When the water level in the reservoir tank is lowered to a predetermined water level by the flush water in the reservoir tank being drained, then the buoyant force does not act on the float provided at the lever member, and the engagement between the rotary pushing portion and the lever member is thus released. When the engagement between the rotary pushing portion and the lever member is released, then the rotary pushing portion is turned, and consequently the selector valve is switched to the side of water supply to the tank. In this manner, the water ejection from the rim water passage portion is stopped, and the flush water flowing in from the water supply source through the water supply valve is supplied to the reservoir tank. When the water level in the reservoir tank is raised by the water supply to the reservoir tank, the lever member is pushed up due to the buoyant force acting on the float. When the water level in the reservoir tank is raised to a predetermined water level, the water supply valve of a ball tap type is opened by the lever member, and the toilet washing tank device is restored to an initial state.

Here, in the toilet washing tank device described in Patent Document 1, engagement between rotary pushing portion and the lever member is released by the flush water in the reservoir tank being drained and by the water level in the reservoir tank being thus lowered, and the selector valve is switched from the side of the rim water passage to the side of the water supply to the tank. Therefore, according to the toilet washing tank device described in Patent Document 1, stopping of the water ejection from the rim spout port is determined depending on the water level in the reservoir tank. However, since the water level in the reservoir tank changes depending on the flow rates of discharged water of the flush water from the reservoir tank and the flush water flowing into the reservoir tank via the water supply valve, it is difficult to finely control the water level.

Also, in the toilet washing tank device described in Patent Document 1, the engagement state between the rotary pushing portion and the lever member is maintained by the buoyant force acting on the float attached to the lever member. Therefore, there may be a case where the engagement between the rotary pushing portion and the lever member is released at an unintended timing due to ruffling or the like of the water surface in the reservoir tank. Therefore, the toilet washing tank device described in Patent Document 1 has a problem that it is difficult to accurately control a timing at which the flush water supplied from the water supply source and ejected from the rim water passage portion is to be stopped.

Therefore, an object of the present invention is to provide a flush water tank device capable of reliably stopping flush water supplied from a water supply source at an accurate timing and a flush toilet apparatus provided with the same.

SUMMARY OF THE INVENTION

In order to solve the aforementioned problem, the present invention provides a flush water tank device for supplying flush water to an upper spout port above a retained water surface in a flush toilet main body and a lower spout port below the retained water surface, the flush water tank device including: a flush water tank main body; a discharge valve that causes the flush water retained in the flush water tank main body to be drained and causes the flush water to be ejected from the lower spout port on the basis of an operation of a user; a first on-off valve for performing switching between an ejection state from the upper spout port and an ejection stopped state of the flush water supplied from a water supply source; a first on-off valve driving mechanism that is moved from a stopped position at which the first on-off valve is brought into the ejection stopped state to an ejection position at which the first on-off valve is brought into the ejection state on the basis of the operation of the user; a biasing mechanism that causes a bias force such that the first on-off valve driving mechanism is moved to the stopped position; a holding mechanism that holds the first on-off valve driving mechanism which has been moved to the ejection position at the ejection position against the bias force caused by the biasing mechanism; and a releasing mechanism that releases the holding of the first on-off valve driving mechanism achieved by the holding mechanism, using the flush water flowing out from the first on-off valve.

In the present invention configured in this manner, the discharge valve causes the flush water retained in the flush water tank main body to be ejected from the lower spout port of the flush toilet main body on the basis of an operation of the user. Also, the first on-off valve driving mechanism is moved from the stopped position at which the first on-off valve is brought into the ejection stopped state to the ejection position at which the first on-off valve is brought into the ejection state on the basis of an operation of the user, and the first on-off valve causes the flush water supplied from the water supply source to be ejected from the upper spout port. Moreover, the biasing mechanism causes a bias force such that the first on-off valve driving mechanism is moved to the stopped position, and the holding mechanism holds the first on-off valve driving mechanism at the ejection position against the bias force caused by the biasing mechanism. The releasing mechanism releases the holding of the first on-off valve driving mechanism achieved by the holding mechanism, using the flush water flowing out from the first on-off valve.

According to the present invention configured in this manner, the held state of the first on-off valve driving mechanism is released and the first on-off valve driving mechanism is moved to the stopped position using the flush water supplied from the water supply source such as tap water and flowing out from the first on-off valve, and it is thus possible to reliably cause the water ejection from the upper spout port to be stopped at an accurate timing without being affected by a water level in the flush water tank main body. Also, since the first on-off valve driving mechanism is biased by the bias force of the biasing mechanism, the bias force is stable, and it is possible to prevent the first on-off valve driving mechanism from being accidentally moved and to cause the first on-off valve driving mechanism to reliably operate.

Preferably, the releasing mechanism causes the holding of the first on-off valve driving mechanism to be released and causes the first on-off valve driving mechanism to move to the stopped position on the basis of an amount of the flush water flowing out from the first on-off valve in the present invention.

According to the present invention configured in this manner, the releasing mechanism causes the holding of the first on-off valve driving mechanism to be released on the basis of the amount of flush water flowing out from the first on-off valve, and it is thus possible to accurately set a time during which the first on-off valve is opened and to finely control the amount of flush water to be ejected from the upper spout port.

Preferably, the flush water flowing out from the first on-off valve is branched and supplied to each of the upper spout port and the releasing mechanism in the present invention.

According to the present invention configured in this manner, the flush water flowing out from the first on-off valve is branched and supplied to each of the upper spout port and the releasing mechanism, and it is thus possible to use the flush water supplied from the water supply source and flowing out from the first on-off valve both for washing the flush toilet and for operating the releasing mechanism.

Preferably, the releasing mechanism includes a water receiving portion into which the flush water supplied from the first on-off valve flows and causes the holding of the first on-off valve driving mechanism achieved by the holding mechanism to be released when the flush water retained in the water receiving portion exceeds a predetermined amount in the present invention.

According to the present invention configured in this manner, the holding of the first on-off valve driving mechanism is released depending on the amount of flush water supplied from the first on-off valve and retained in the water receiving portion, and it is thus possible to release the holding achieved by the holding mechanism on the basis of the amount of flush water with a simple mechanism.

Preferably, a second on-off valve for causing the discharge valve to open is further included, the releasing mechanism causing the holding of the first on-off valve driving mechanism to be released and causing the second on-off valve to open when the flush water retained in the water receiving portion exceeds a predetermined amount in the present invention.

According to the present invention configured in this manner, the releasing mechanism causes the holding of the first on-off valve driving mechanism to be released and causes the second on-off valve to open when the flush water retained in the water receiving portion exceeds the predetermined amount, and it is thus possible to control the discharge valve as well using the flush water flowing out from the first on-off valve.

Preferably, a water pressure driving mechanism that causes the discharge valve to open and close is further included, the water pressure driving mechanism causing the discharge valve to open by a water pressure of the flush water supplied via the second on-off valve in the present invention.

According to the present invention configured in this manner, the water pressure driving mechanism that causes the discharge valve to open and close is included, and it is thus possible to cause the discharge valve to open even with a relatively small amount of flush water flowing out from the second on-off valve.

Preferably, the biasing mechanism includes a small tank that is provided inside the flush water tank main body and retains the flush water and a biasing float that is disposed inside the small tank, and the biasing mechanism uses a buoyant force acting on the biasing float in the present invention to generate the bias force.

According to the present invention configured in this manner, the bias force caused by the biasing mechanism is caused using the buoyant force acting on the biasing float, and it is thus possible to reliably cause the bias force with a simple mechanism. Also, since the biasing float is disposed in the small tank, it is possible to cause a stable bias force regardless of a water level in the flush water tank main body.

Preferably, the holding mechanism includes an engaging member and an engaged member that is engaged with the engaging member, and the first on-off valve driving mechanism is held at the ejection position by the engaging member engaging with the engaged member in the present invention.

According to the present invention configured in this manner, the holding mechanism holds the first on-off valve driving mechanism at the ejection position by the engaging member engaging with the engaged member, and it is thus possible to reliably hold the first on-off valve driving mechanism at the ejection position with a simple mechanism.

Preferably, the engaging member is provided such that the engaging member is movable between an engagement position and an engagement released position, and the engaging member is biased by an elastic member toward the engagement position in the present invention.

According to the present invention configured in this manner, the engaging member is biased by the elastic member toward the engagement position, and it is thus possible to reliably cause the engaging member to move to the engagement position and to cause the holding mechanism to reliably operate with a simple mechanism.

Preferably, the engaging member includes a sloped surface, and when the first on-off valve driving mechanism is moved to the ejection position based on the operation of the user, the engaging member is moved toward the engagement released position against a bias force of the elastic member by the sloped surface sliding along the engaged member in the present invention.

According to the present invention configured in this manner, the engaging member is moved toward the engagement released position by the sloped surface of the engaging member sliding along the engaged member, and it is thus possible to reliably cause the engaging member to move with a simple mechanism on the basis of an operation of the user.

Also, the present invention provides a flush toilet apparatus including: a flush toilet main body that includes an upper spout port above a retained water surface and a lower spout port below the retained water surface; and the flush water tank device according to the present invention that supplies the flush water to the upper spout port and the lower spout port According to the flush water tank device of the present invention, it is possible to accurately set an ejection timing of flush water without using a motor for pulling up the discharge valve.

DETAILED DESCRIPTION OF THE PREFERRED EMBODIMENTS

Next, a flush toilet apparatus according to embodiments of the present invention will be described with reference to the accompanying drawings.

Figure 1:
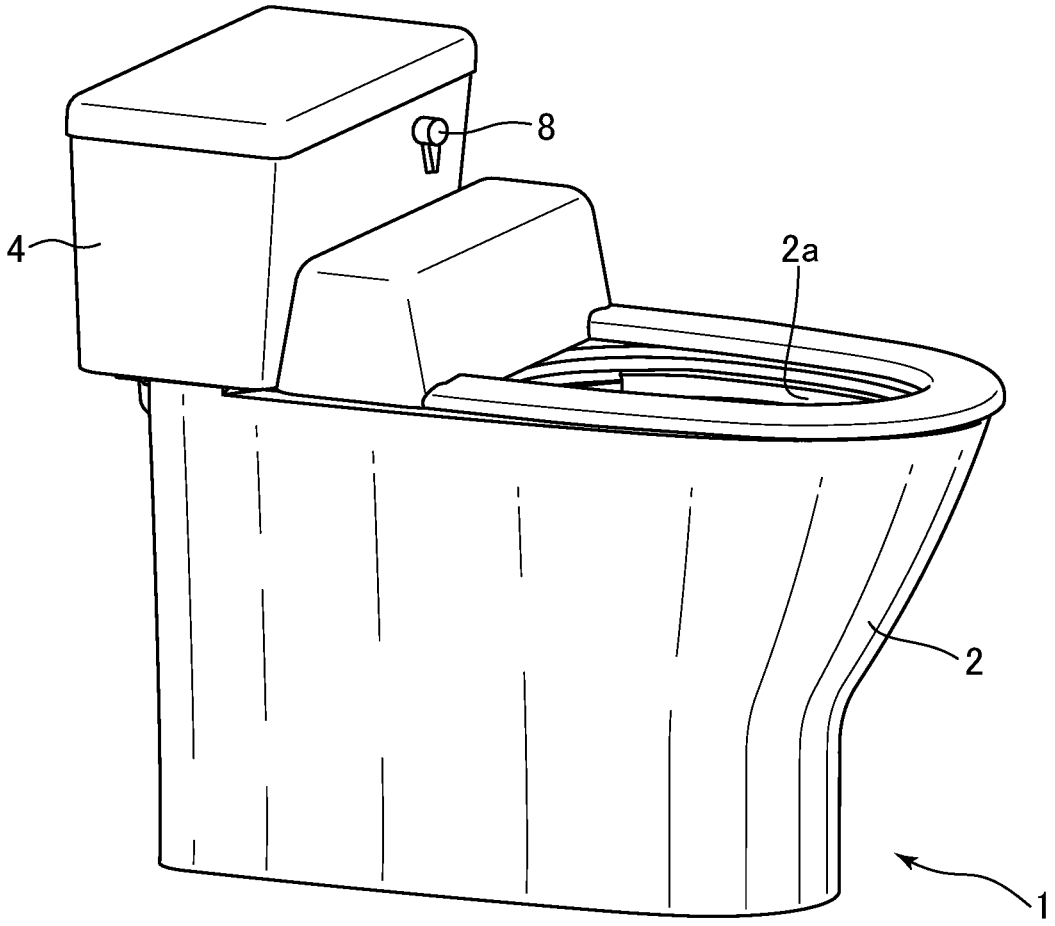
FIG. 1 is a perspective view illustrating an overall flush toilet apparatus according to an embodiment of the present invention.
Figure 2:
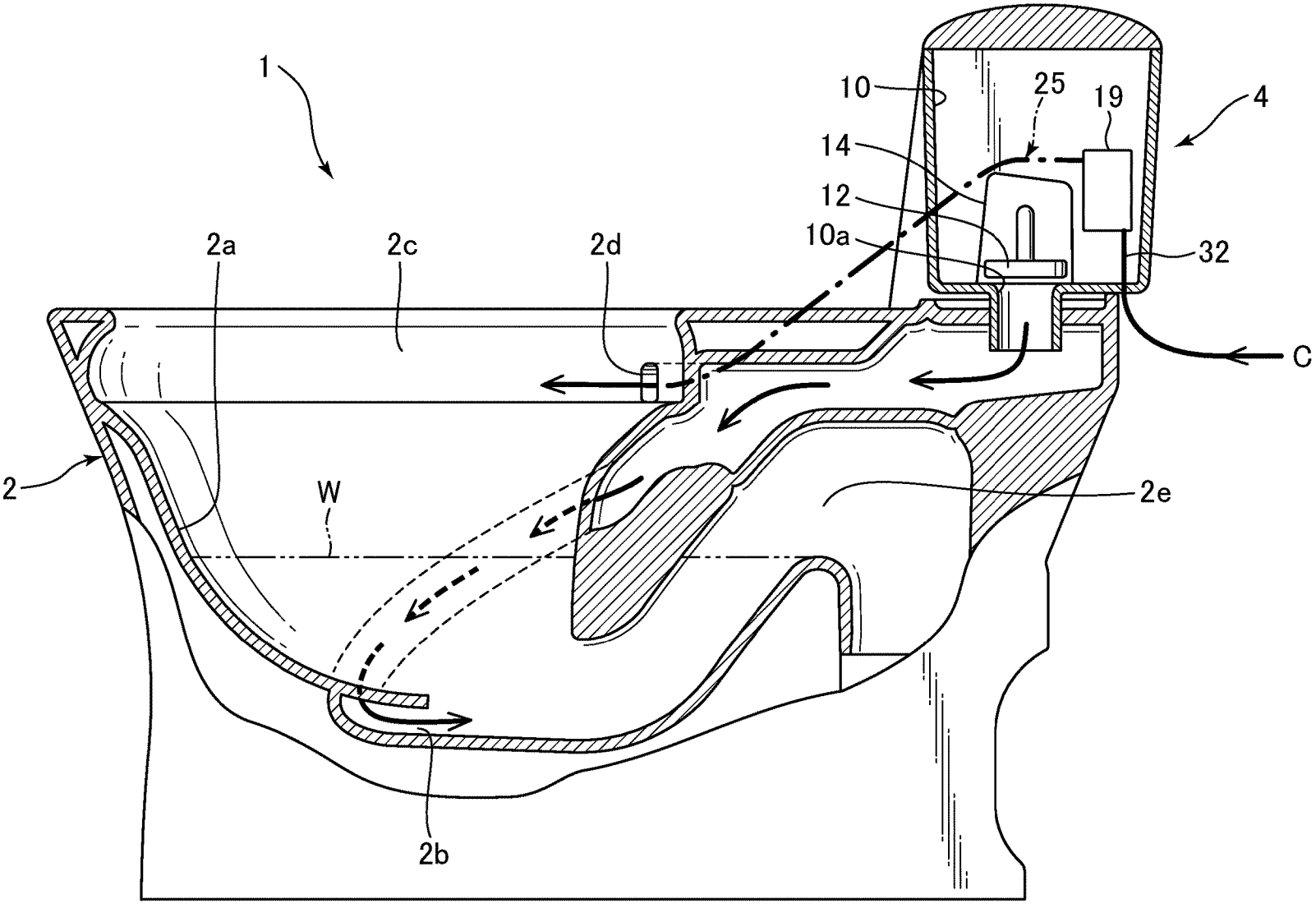
FIG. 2 is an overall sectional view of the flush toilet apparatus according to the embodiment of the present invention.
Figure 3:
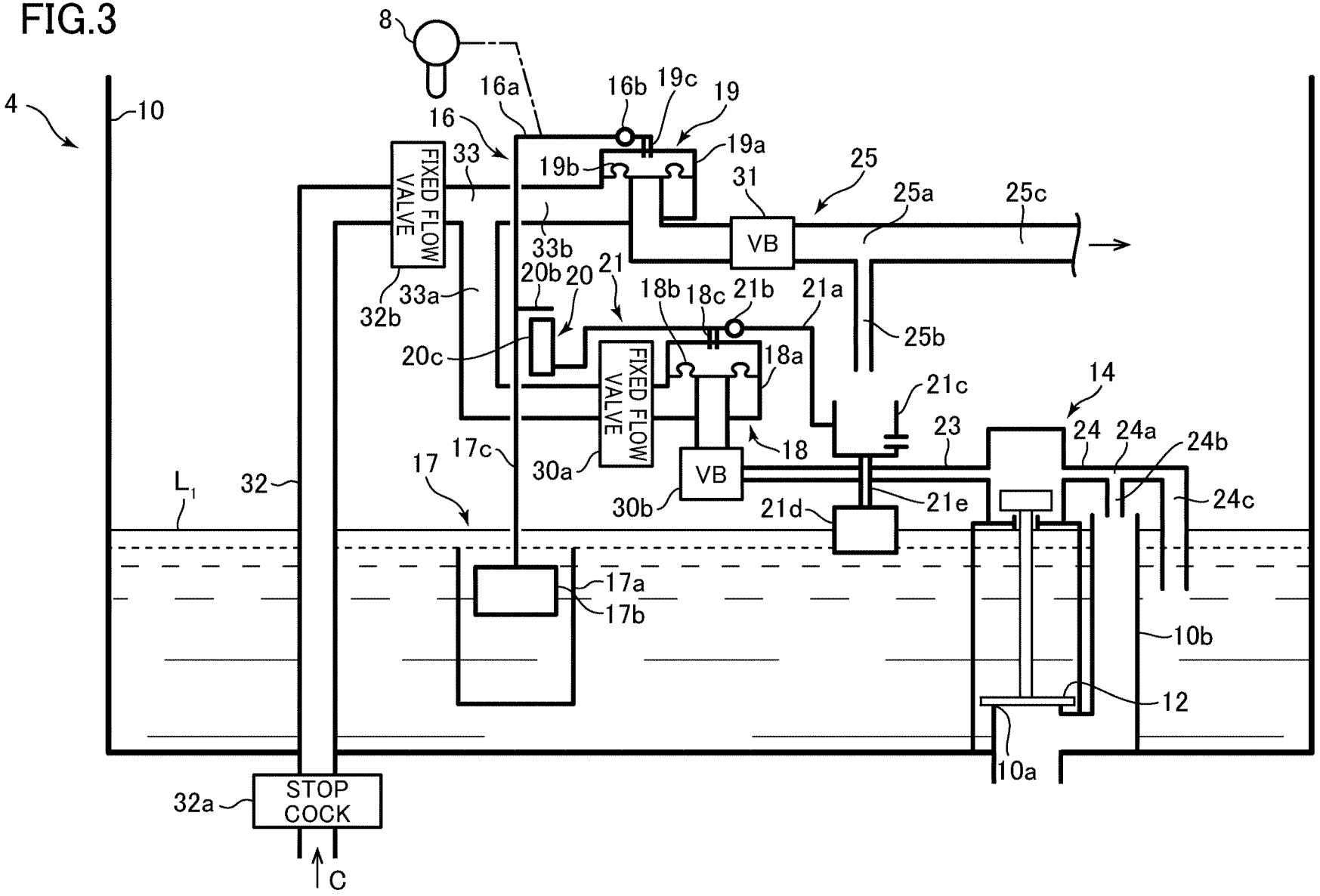
FIG. 3 is a sectional view illustrating an overview configuration of a flush water tank device according to the embodiment of the present invention.
Figure 4:
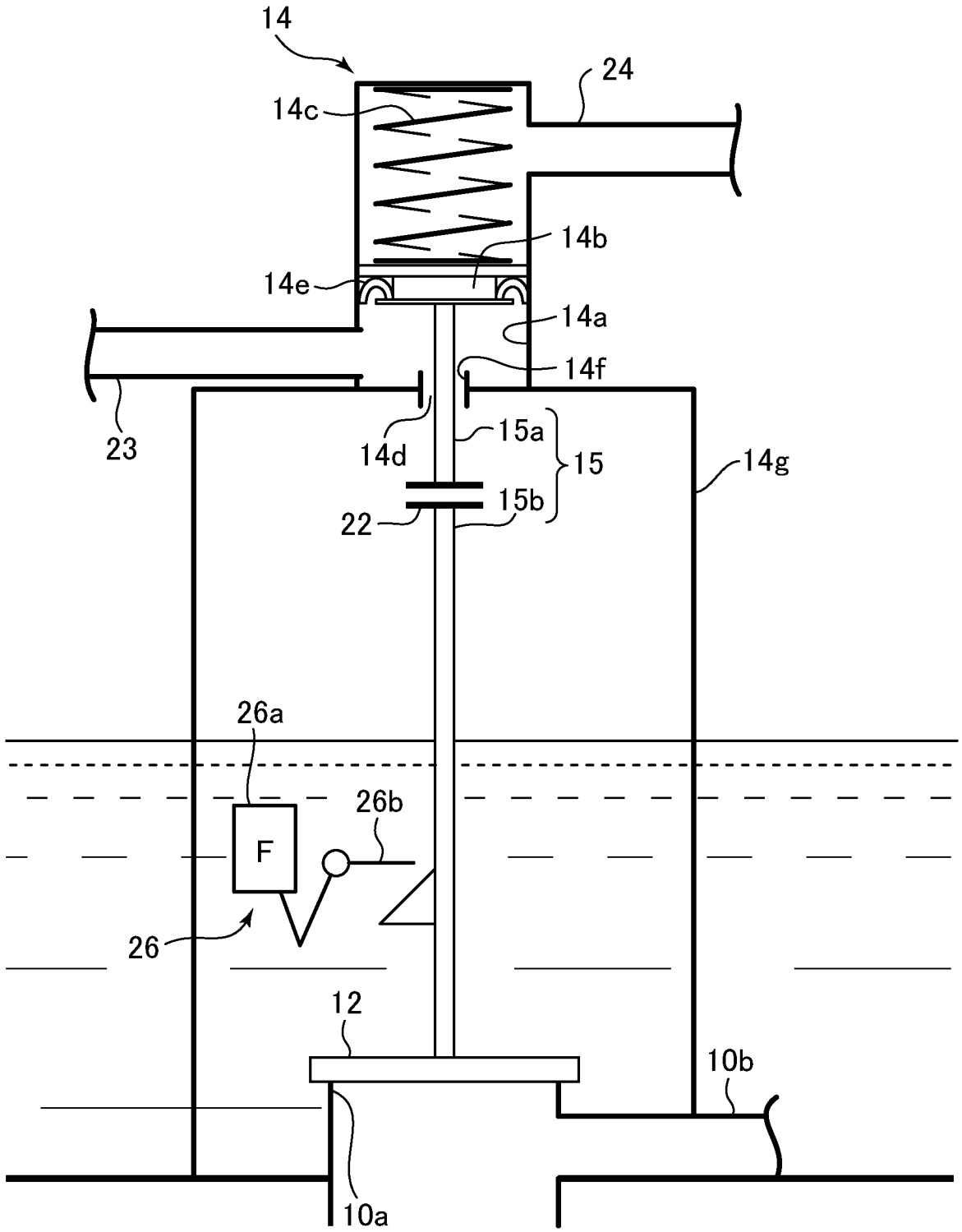
FIG. 4 is a sectional view illustrating an overview configuration of a discharge valve water pressure drive portion included in the flush water tank device according to the embodiment of the present invention.
Figure 5:
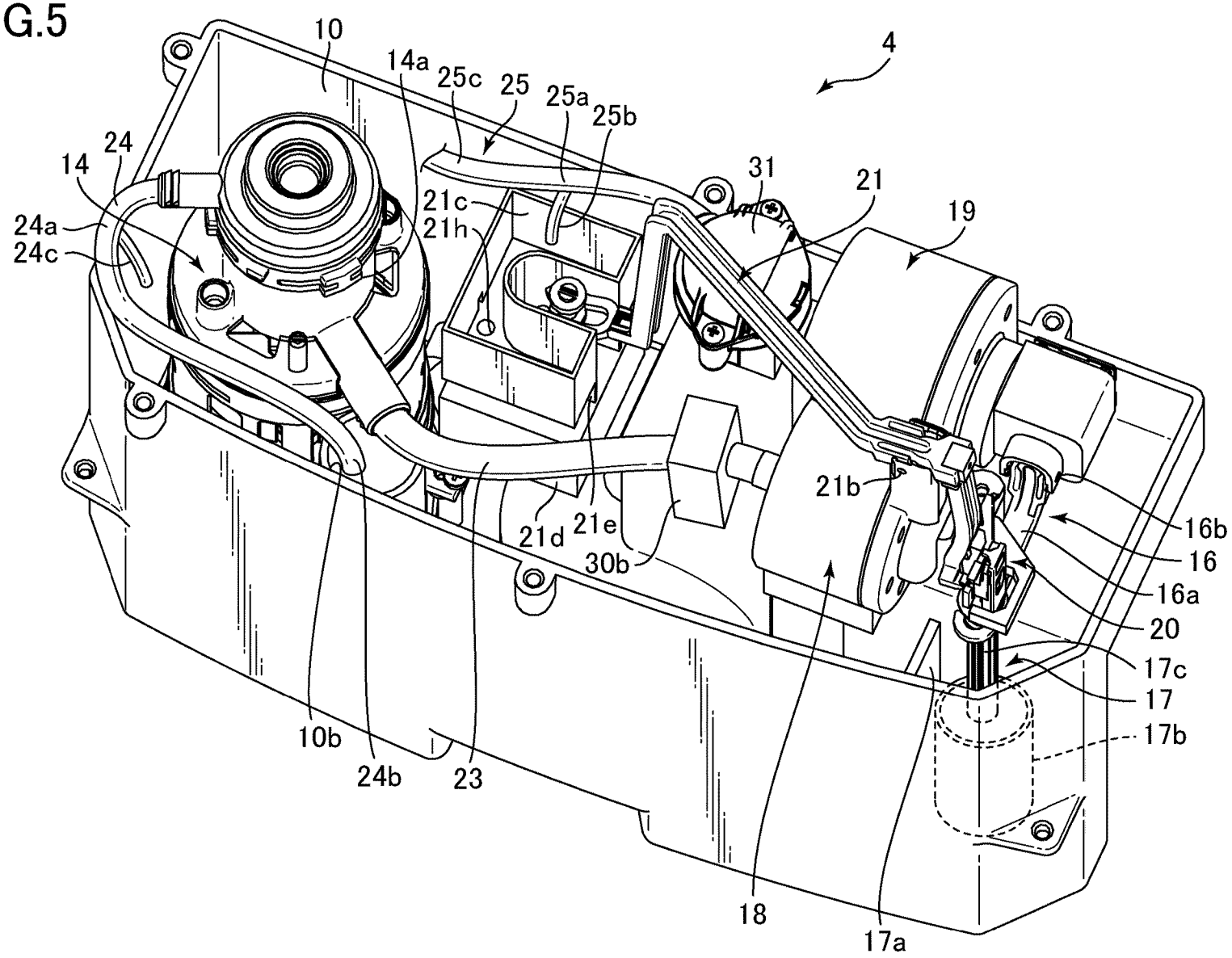
FIG. 5 is a perspective view illustrating the overall flush water tank device according to the embodiment of the present invention.

FIG. 1 is a perspective view illustrating an overall flush toilet apparatus according to an embodiment of the present invention. FIG. 2 is an overall sectional view of the flush toilet apparatus according to the embodiment of the present invention. FIG. 3 is a sectional view illustrating an overview configuration of a flush water tank device according to the embodiment of the present invention. FIG. 4 is a sectional view illustrating an overview configuration of a discharge valve water pressure drive portion included in the flush water tank device according to the embodiment of the present invention. FIG. 5 is a perspective view illustrating the overall flush water tank device according to the embodiment of the present invention.

As illustrated in FIGS. 1 and 2, a flush toilet apparatus 1 according to the embodiment of the present invention is configured by a flush toilet main body 2 and a flush water tank device 4 according to the embodiment of the present invention placed at a rear portion thereof. The flush toilet apparatus 1 according to the present embodiment is configured such that a bowl 2*a* of the flush toilet main body 2 is washed in response to an operation performed on a lever handle 8 provided in the flush water tank device 4 after utilization. The flush water tank device 4 according to the present embodiment is configured to supply flush water retained therein and flush water supplied from tap water C that is a water supply source to the flush toilet main body 2 and wash the bowl 2*a* with the flush water on the basis of an operation on the lever handle 8.

Additionally, as a modification example, the present invention can also be configured such that the bowl 2*a* is washed in response to an operation performed on a remote controller device (not illustrated) attached to a wall surface. Alternatively the present invention can also be configured such that the bowl 2*a* is washed in response to elapse of a predetermined time after a human sensor (not illustrated) provided at a toilet seat detects separation of a user from the seat. In this case, the human sensor (not illustrated) can be provided at the toilet seat, can be provided at a position where it can detect a user's motion of being seated, being separated from the seat, approaching the seat, leaving, or placing his/her hand near it, and for example, it is possible to provide the human sensor in the flush toilet main body 2 or the flush water tank device 4. Also, any human sensor (not illustrated) can be used as long as it can detect the user's motion of being seated, being separated from the seat, approaching the seat, leaving, or placing his/her hand, and for example, it is possible to use an infrared sensor or a microwave sensor as the human sensor. As described above, "on the basis of the user's operation" in the present specification means a user's arbitrary motion that serves as a trigger to start washing the toilet.

Next, the flush water tank device 4 includes a reservoir tank 10 that is a flush water tank main body for retaining flush water to be supplied to the flush toilet main body 2, a discharge valve 12 for opening and closing a drain port 10*a* provided in the reservoir tank 10, and a discharge valve water pressure drive portion 14 that is a water pressure driving mechanism for driving the discharge valve 12 as illustrated in FIG. 2. Furthermore, the flush water tank device 4 includes a water supply control valve 19 that is a first on-off valve for supplying flush water supplied from tap water C directly to the flush toilet main body 2. Here, a configuration in which the flush water retained in the reservoir tank 10 and caused to flow out by the discharge valve 12 being opened is ejected from a jet spout port 2*b* that is a lower spout port provided on the lower side of a retained water surface W in the bowl 2*a* of the flush toilet main body 2 at the time of washing of the toilet is adopted. Also, a configuration in which the flush water supplied from the tap water C and supplied via the water supply control valve 19 is ejected from a rim spout port 2*d* that is an upper spout port provided at a rim 2*c* of the bowl 2*a* above the retained water surface W in the bowl 2*a* at the time of washing of the toilet is adopted.

Next, the flush water tank device 4 further includes a water supply valve driving mechanism 16 that is a first on-off valve driving mechanism that is moved from a stopped position at which the water supply control valve 19 is brought into an ejection stopped state to an ejection position at which the water supply control valve 19 is brought into an ejection state on the basis of an operation of the user and a biasing mechanism 17 that causes a bias force such that the water supply valve driving mechanism 16 is moved to the stopped position as illustrated in FIGS. 3 and 5. Also, the flush water tank device 4 includes a holding mechanism 20 that holds, at the ejection position, the water supply valve driving mechanism 16 moved to the ejection position against the bias force caused by the biasing mechanism 17 and a releasing mechanism 21 that releases the holding of the water supply valve driving mechanism 16 achieved by the holding mechanism 20 using flush water flowing out from the water supply control valve 19. Furthermore, the flush water tank device 4 includes a discharge valve control valve 18 that is a second on-off valve for controlling water supply to the discharge valve water pressure drive portion 14.

The reservoir tank 10 is a tank configured to retain the flush water to be supplied to the jet spout port 2*b* of the flush toilet main body 2, and the drain port 10*a* (FIG. 3) for discharging the retained flush water to the flush toilet main body 2 is formed at a bottom portion thereof. Also, an overflow pipe 10*b* is connected to a downstream side of the drain port 10*a* inside the reservoir tank 10. The overflow pipe 10*b* stands vertically from the vicinity of the drain port 10*a* and extends upward beyond a stopped water level $L_1$ of the flush water retained in the reservoir tank 10. Therefore, the flush water flowing in from an upper end of the overflow pipe 10*b* bypasses the drain port 10*a* and flows out directly from the jet spout port 2*b* of the flush toilet main body 2.

As illustrated in FIG. 4, the discharge valve 12 has a valve body disposed to open and close the drain port 10*a* and is opened by the discharge valve 12 being pulled upward, and the flush water in the reservoir tank 10 is discharged to the flush toilet main body 2 and is ejected from the jet spout port 2*b* provided at a lower portion of the bowl 2*a*.

Next, a structure of the discharge valve water pressure drive portion 14 will be described with reference to FIG. 4.

The discharge valve water pressure drive portion 14 is configured to drive the discharge valve 12 using a water supply pressure of the flush water supplied from the tap water C. As illustrated in FIG. 4, the discharge valve water pressure drive portion 14 includes a cylinder 14*a* into which water that has flowed out from the discharge valve control valve 18 and has been supplied through an inlet pipe 23 flows, a piston 14*b* that is slidably disposed in the cylinder 14*a*, and a rod 15 that projects from a lower end of the cylinder 14*a* and drives the discharge valve 12. Moreover, a spring 14*c* is disposed inside the cylinder 14*a* and biases the piston 14*b* downward, a packing 14*e* is attached to the piston 14*b*, and water tightness is secured between an inner wall surface of the cylinder 14*a* and the piston 14*b*. Also, the cylinder 14*a* is supported above the drain port 10*a* by a frame 14*g*. Furthermore, a clutch mechanism 22 is provided at a midpoint of the rod 15, and the rod 15 is separated into an upper rod 15*a* and a lower rod 15*b* by the clutch mechanism 22.

The cylinder 14*a* is a cylindrical member, is disposed with an axial line thereof directed in a vertical direction, and slidably receives the piston 14*b* therein. Also, the inlet pipe 23 is connected to a lower end portion of the cylinder 14*a* such that water flowing out from the discharge valve control valve 18 flows into the cylinder 14*a* from the lower end portion. Therefore, the piston 14*b* in the cylinder 14*a* is pushed upward against a biasing force of the spring 14*c* due to the water that has flowed into the cylinder 14*a*.

On the other hand, an outlet hole is provided at an upper end portion of the cylinder 14*a*, and the outlet pipe 24 communicates with the inside of the cylinder 14*a* through the outlet hole. Therefore, once water flows into the cylinder 14*a* from the inlet pipe 23 connected to the lower portion of the cylinder 14*a*, the piston 14*b* is pushed upward from the lower portion of the cylinder 14*a*. Then, when the piston 14*b* is pushed upward above the outlet hole, the water flowing into the cylinder 14*a* flows out from the outlet hole through the outlet pipe 24. In other words, the inlet pipe 23 and the outlet pipe 24 communicate with each other via the inside of the cylinder 14*a* when the piston 14*b* is moved upward.

Also, as illustrated in FIGS. 3 and 5, the outlet pipe 24 is provided with a branching portion 24*a*, and a first downcomer 24*b* branched from the branching portion 24*a* opens downward inside the overflow pipe 10*b*. A second downcomer 24*c* extending downward from the branching portion 24*a* allows water to flow out into the reservoir tank 10. Therefore, a part of the flush water flowing out from the cylinder 14*a* flows into the overflow pipe 10*b*, and remaining flush water is retained in the reservoir tank 10.

Next, as illustrated in FIG. 4, the rod 15 is a rod-shaped member connected to a lower surface of the piston 14*b* and extends to project downward from the inside of the cylinder 14*a* through a through-hole 14*f* formed in a bottom surface of the cylinder 14*a*. Also, the discharge valve 12 is connected to the lower end of the rod 15, and the rod 15 connects the piston 14*b* to the discharge valve 12. Therefore, when water flows into the cylinder 14*a* and the piston 14*b* is pushed upward, the rod 15 connected to the piston 14*b* lifts the discharge valve 12 upward, and the discharge valve 12 is opened.

Also, a clearance 14*d* is provided between the rod 15 projecting from the lower side of the cylinder 14*a* and an inner wall of the through-hole 14*f* of the cylinder 14*a*, and a part of water flowing into the cylinder 14*a* flows out from the clearance 14*d*. The water flowing out from the clearance 14*d* flows into the reservoir tank 10. Note that since the clearance 14*d* is relatively narrow, and a flow channel resistance is large, the pressure in the cylinder 14*a* increases due to the water flowing into the cylinder 14*a* from the inlet pipe 23 even in a state in which the water flows out from the clearance 14*d*, and the piston 14*b* is pushed upward against the biasing force of the spring 14*c*.

Furthermore, the clutch mechanism 22 is provided at a midpoint of the rod 15. The clutch mechanism 22 is configured to separate the rod 15 into the upper rod 15*a* and the lower rod 15*b* when the discharge valve 12 is lifted by a predetermined distance along with the rod 15. In a state in which the clutch mechanism 22 is separated, the lower rod 15*b* does not move in conjunction with motion of the piston 14*b* and an upper portion of the upper rod 15*a*, and the lower rod 15*b* is lowered due to a gravity along with the discharge valve 12 while working against the buoyant force.

Also, a discharge valve float mechanism 26 is provided in the vicinity of the discharge valve 12. The discharge valve float mechanism 26 is configured such that a delay is applied to the lower rod 15*b* and the discharge valve 12 being lowered and causing the drain port 10*a* to be closed after the rod 15 is lifted by a predetermined distance and the lower rod 15*b* is separated by the clutch mechanism 22. Specifically, the discharge valve float mechanism 26 includes a float portion 26*a* and an engaging portion 26*b* that moves in conjunction with the float portion 26*a*.

The engaging portion 26*b* is configured to establish engagement with the lower rod 15*b* separated and lowered by the clutch mechanism 22 and prevent the lower rod 15*b* and the discharge valve 12 from being lowered and seated in the drain port 10*a*. Then, when the float portion 26*a* is lowered along with lowering of a water level in the reservoir tank 10, and the water level in the reservoir tank 10 is lowered to a predetermined water level, then the float portion 26*a* causes the engaging portion 26*b* to turn, and the engagement between the engaging portion 26*b* and the lower rod 15*b* is released. Through the release of the engagement, the lower rod 15*b* and the discharge valve 12 are lowered and are seated in the drain port 10*a*. In this manner, the closing of the discharge valve 12 is delayed, and an appropriate amount of flush water is drained from the drain port 10*a*.

Also, as illustrated in FIG. 3, a fixed flow valve 30*a* is provided on the upstream side of the discharge valve control valve 18. The fixed flow valve 30*a* is configured to adjust a flow rate such that the flush water supplied from the tap water C flows into the discharge valve control valve 18 at a flow rate that is appropriate to cause the discharge valve water pressure drive portion 14 to operate. Furthermore, the inlet pipe 23 that connects the discharge valve control valve 18 to the discharge valve water pressure drive portion 14 is provided with a vacuum breaker 30*b*. In a case in which a pressure on the side of the discharge valve control valve 18 becomes a negative pressure, the vacuum breaker 30*b* suctions external air to the inlet pipe 23 and prevents a backflow of water from the side of the discharge valve water pressure drive portion 14.

Figure 11:
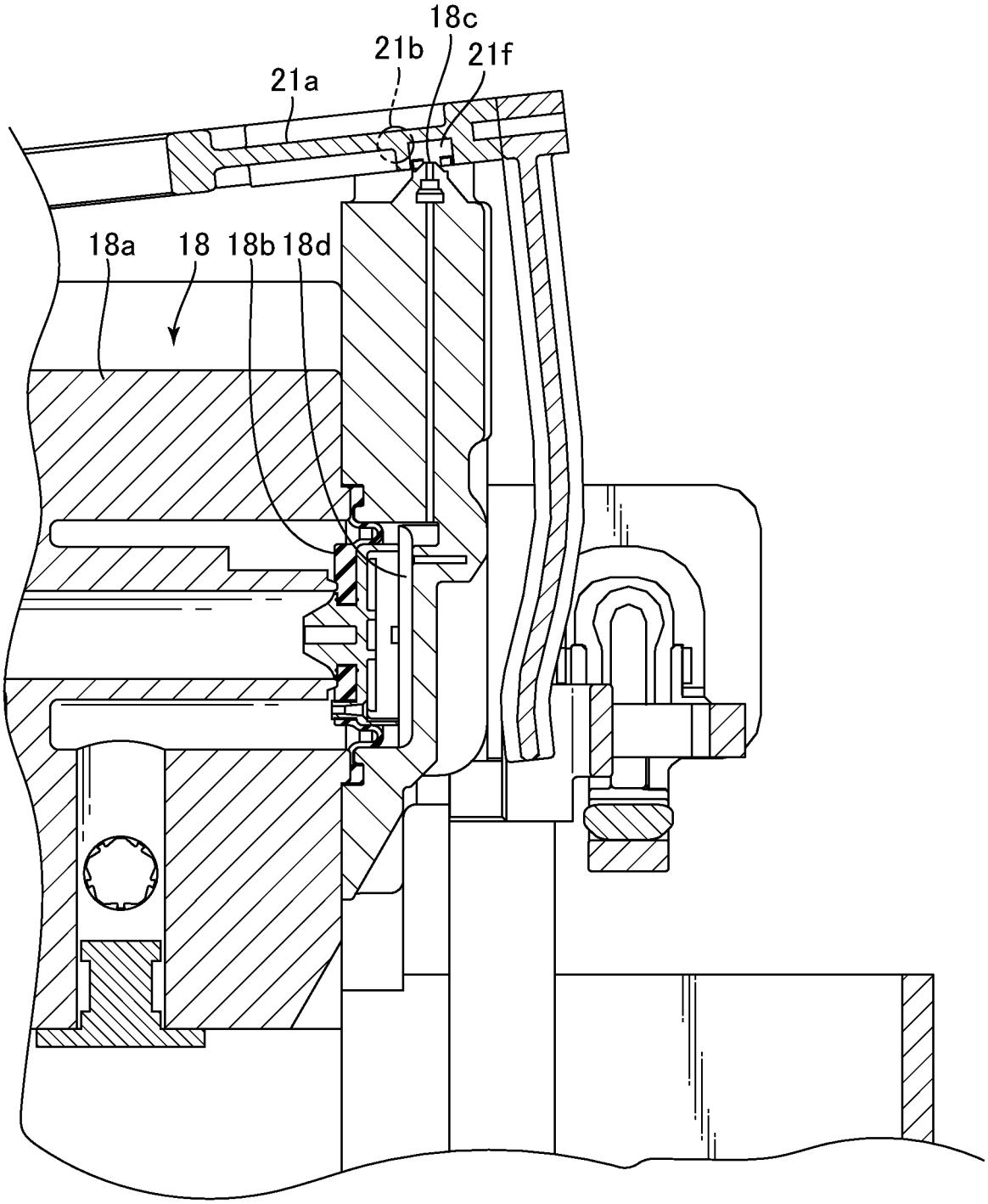
FIG. 11 is a sectional view illustrating an internal structure of a discharge valve control valve included in the flush water tank device according to the embodiment of the present invention.

Next, the discharge valve control valve 18 includes a control valve main body portion 18*a*, a main valve body 18*b* disposed in the control valve main body portion 18*a*, and a pilot valve port 18*c* (FIG. 11). Note that the pilot valve port 18*c* included in the discharge valve control valve 18 is configured to be opened and closed by the releasing mechanism 21 as will be described later. When the pilot valve port 18*c* is opened, then the pressure in the pressure chamber 18*d* (FIG. 11) provided in the control valve main body portion 18*a* is lowered, and the main valve body 18*b* of the discharge valve control valve 18 is opened. Also, when the pilot valve port 18*c* is closed, the pressure in the pressure chamber 18*d* is raised, and the main valve body 18*b* is closed. In this manner, the main valve body 18*b* of the discharge valve control valve 18 is opened or closed on the basis of the operation of the releasing mechanism 21, and water supply to the discharge valve water pressure drive portion 14 and stopping are controlled.

In other words, the discharge valve control valve 18 controls supply and stopping of the supplied flush water to the discharge valve water pressure drive portion 14. In the present embodiment, the entire amount of flush water flowing out from the discharge valve control valve 18 is supplied to the discharge valve water pressure drive portion 14 through the inlet pipe 23 as illustrated in FIG. 3. A part of the flush water that has been supplied to the discharge valve water pressure drive portion 14 flows out from the clearance 14*d* between the inner wall of the through-hole 14*f* (FIG. 4) of the cylinder 14*a* and the rod 15 and flows into the reservoir tank 10. Also, a large part of the water that has been supplied to the discharge valve water pressure drive portion 14 flows out from the cylinder 14*a* through the outlet pipe 24 and flows into each of the overflow pipe 10*b* and the reservoir tank 10 as described above.

On the other hand, the flush water supplied from the tap water C is supplied to the discharge valve control valve 18 via a stop cock 32*a*, a fixed flow valve 32*b*, a water supply pipe branching portion 33, and a first branching pipe 33*a* as illustrated in FIG. 3. The stop cock 32*a* is disposed outside the reservoir tank 10, and the fixed flow valve 32*b* is connected to the inside of the reservoir tank 10 on the downstream side thereof. The water supply pipe branching portion 33 is provided on the downstream side of the fixed flow valve 32*b*, and the first branching pipe 33*a* branched by the water supply pipe branching portion 33 is connected to the discharge valve control valve 18.

The stop cock 32*a* is provided to stop water supply to the flush water tank device 4 at the time of maintenance or the like and is typically used in an opened state. The fixed flow valve 32*b* is provided to allow water supplied from the tap water C to flow into the discharge valve control valve 18 and the water supply control valve 19 at a predetermined flow rate and is configured such that water is supplied at a constant flow rate regardless of an installation environment of the flush toilet apparatus 1.

On the other hand, a second branching pipe 33*b* branched by the water supply pipe branching portion 33 is connected to the water supply control valve 19.

The water supply control valve 19 is configured to cause water supplied from the second branching pipe 33*b* to flow out to a rim water supply pipe 25. The rim water supply pipe 25 communicates with the rim spout port 2*d* of the flush toilet main body 2 (not illustrated in FIG. 3), and the flus water that has flowed into the rim water supply pipe 25 is ejected as rim flush water for washing the bowl 2*a* from the rim spout port 2*d*. Also, a vacuum breaker (FIG. 5) is provided at a midpoint of the rim water supply pipe 25. It is thus possible to prevent water from flowing backward from the side of the flush toilet main body 2 to the water supply control valve 19 when the pressure on the side of the water supply control valve 19 becomes a negative pressure. Furthermore, the rim water supply pipe 25 on the downstream side of the vacuum breaker 31 is provided with a branching portion 25*a*, a part of the flush water flowing in the rim water supply pipe 25 flows into the downcomer 25*b*, and remaining flush water is ejected from the rim spout port 2*d*.

Figure 10:
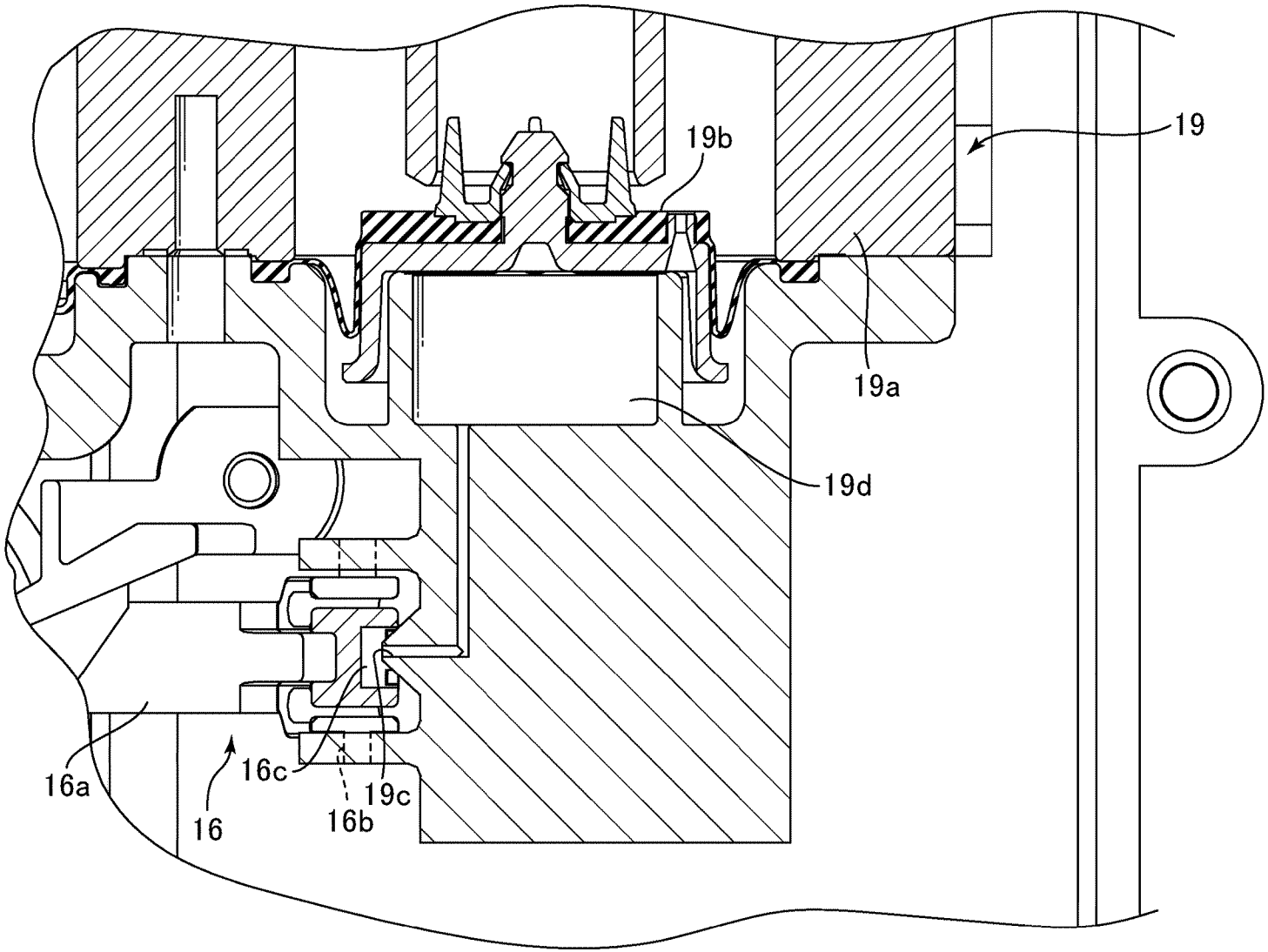
FIG. 10 is a sectional view illustrating an internal structure of a water supply control valve included in the flush water tank device according to the embodiment of the present invention.

The water supply control valve 19 includes a water supply valve main body portion 19*a*, a main valve body 19*b* disposed in the water supply valve main body portion 19*a*, and a pilot valve port 19*c* (FIG. 10). Also, the pilot valve port 19*c* included in the water supply control valve 19 is configured to be opened and closed by the water supply valve driving mechanism 16 as will be described later. In other words, the water supply valve driving mechanism 16 is configured to control the pressure in a pressure chamber 19*d* (FIG. 10) provided in the water supply valve main body portion 19*a* by opening and closing the pilot valve port 19*c* provided at the water supply valve main body portion 19*a*.

Next, newly referring to FIGS. 6 to 11, configurations of the water supply valve driving mechanism 16, the biasing mechanism 17, the holding mechanism 20, and the releasing mechanism 21 will be described.

Figure 6:
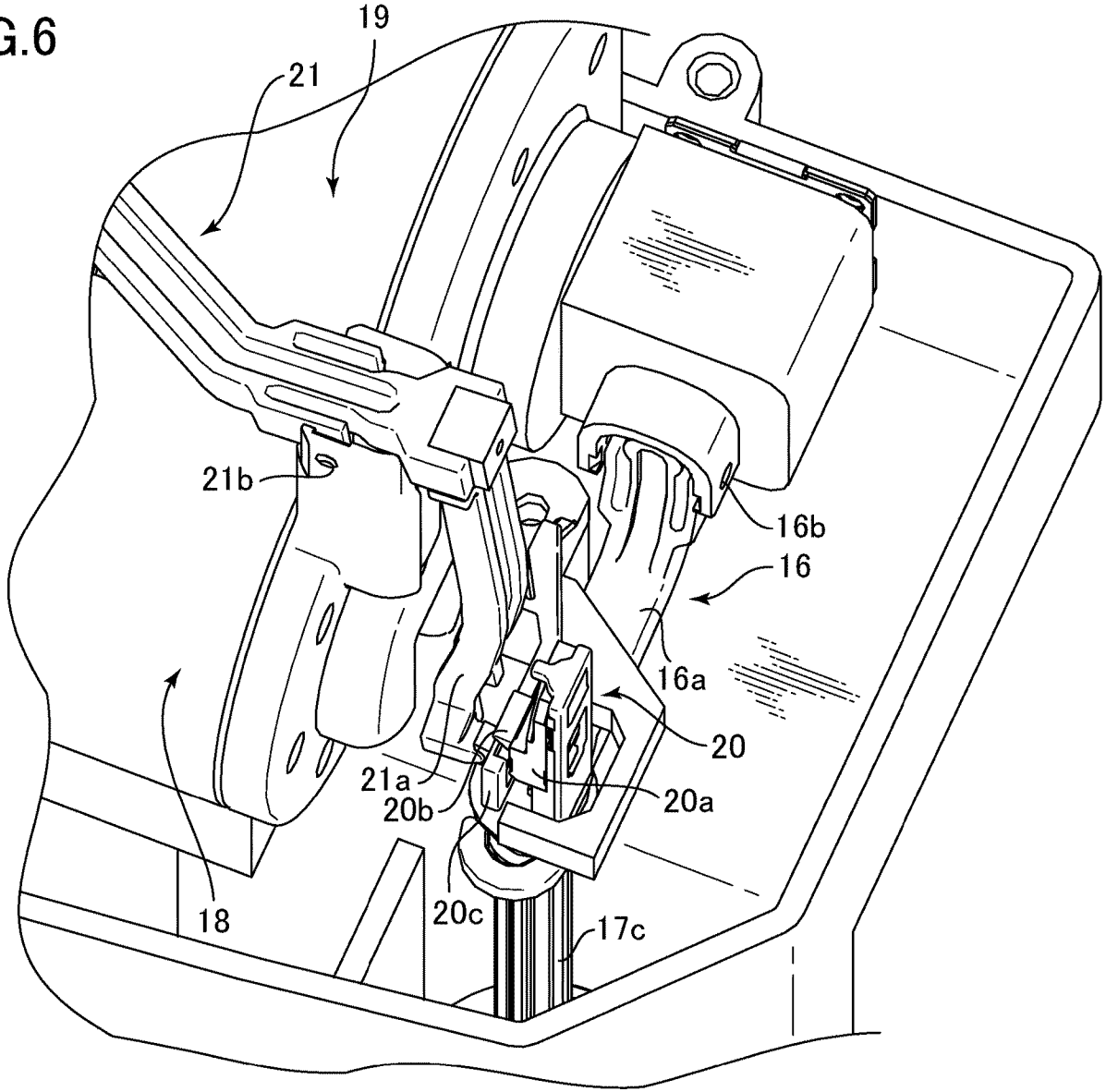
FIG. 6 is a perspective view partially illustrating a water supply valve driving mechanism and a releasing mechanism included in the flush water tank device according to the embodiment of the present invention.
Figure 7:
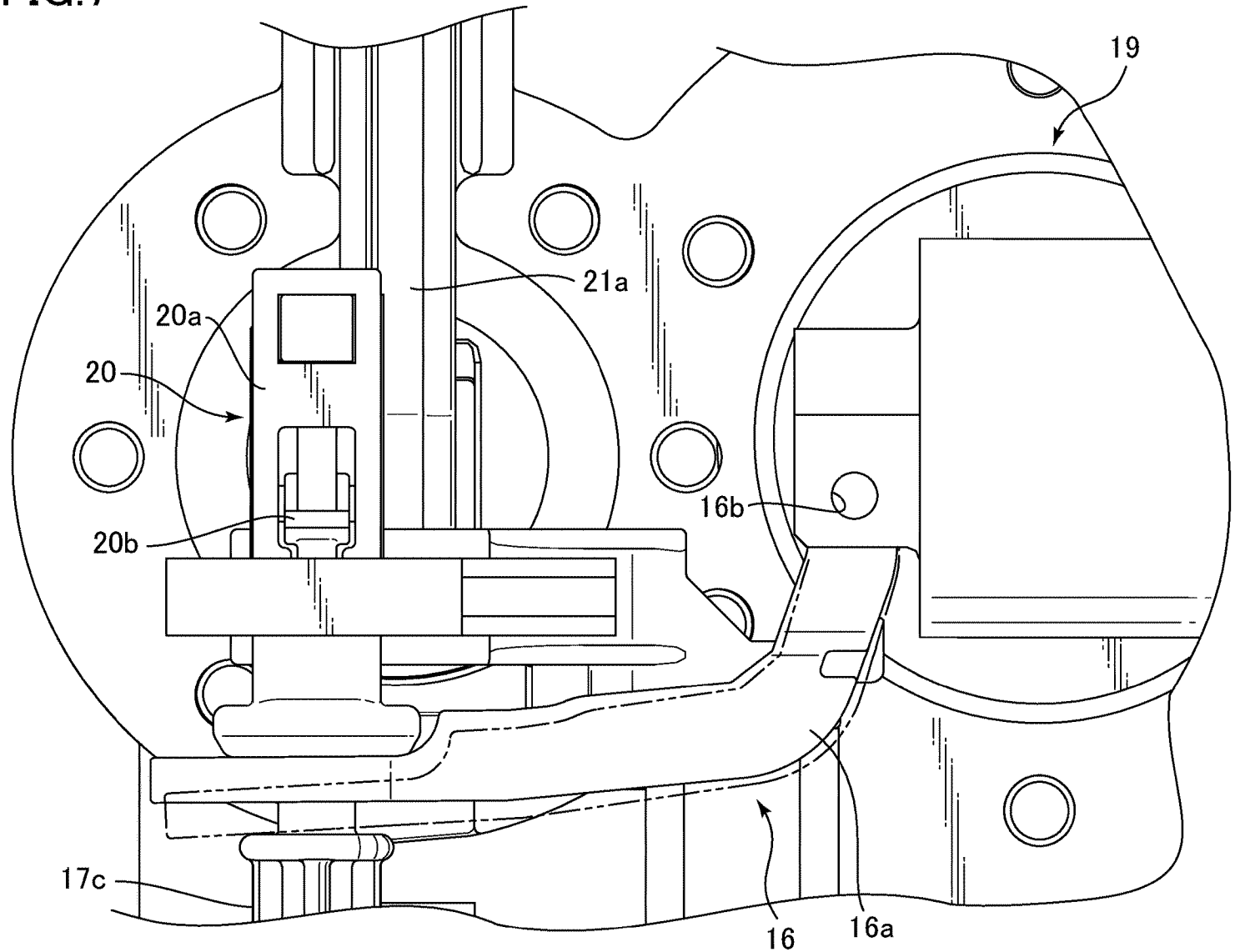
FIG. 7 is a side view illustrating the water supply valve driving mechanism included in the flush water tank device according to the embodiment of the present invention in an enlarged manner.
Figure 8:
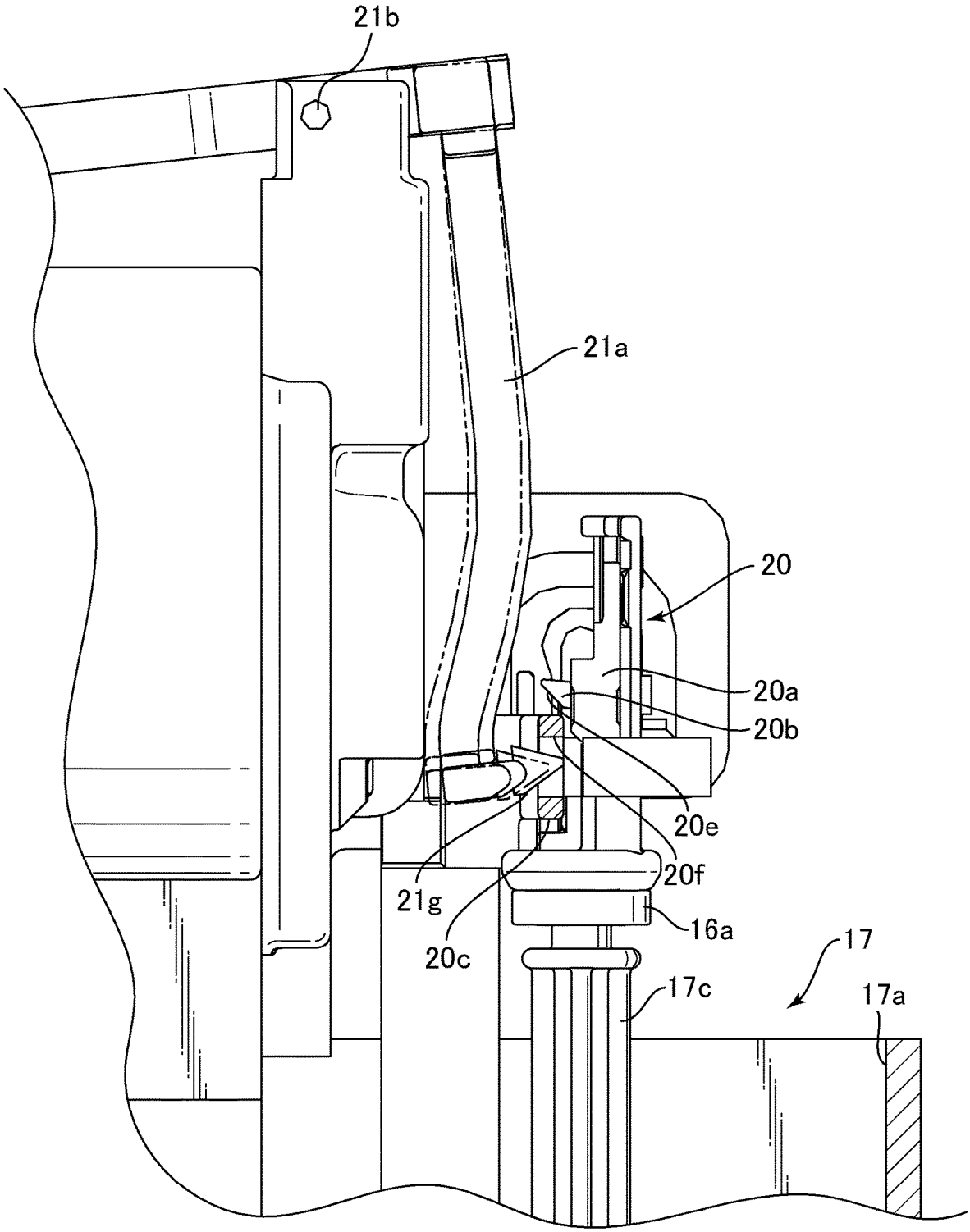
FIG. 8 is a back view illustrating a holding mechanism and the releasing mechanism included in the flush water tank device according to the embodiment of the present invention in an enlarged manner.
Figure 9:
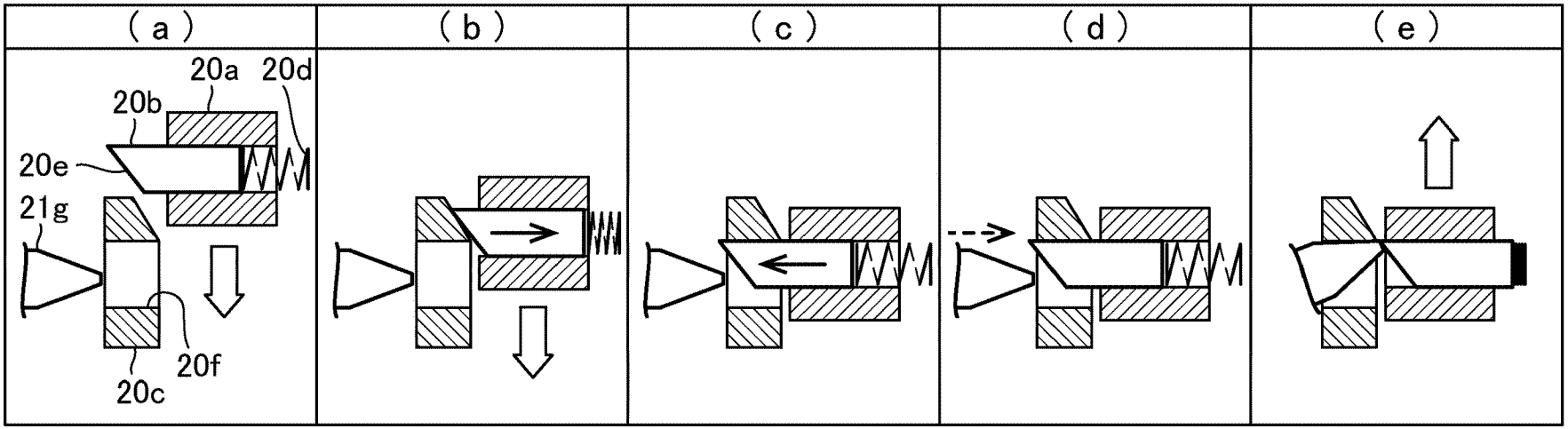
FIG. 9 is a schematic view for explaining effects of the holding mechanism and the releasing mechanism included in the flush water tank device according to the embodiment of the present invention.

FIG. 6 is a perspective view partially illustrating the water supply valve driving mechanism 16 and the releasing mechanism 21. FIG. 7 is a side view illustrating the water supply valve driving mechanism 16 in an enlarged manner. FIG. 8 is a back view illustrating the holding mechanism 20 and the releasing mechanism 21 in an enlarged manner. FIG. 9 is a schematic view for explaining effects of the holding mechanism 20 and the releasing mechanism 21. FIG. 10 is a sectional view illustrating an internal structure of the water supply control valve 19. FIG. 11 is a sectional view illustrating an internal structure of the discharge valve control valve 18.

As illustrated in FIGS. 6 and 7, the water supply valve driving mechanism 16 is configured of a drive arm member 16*a* that is curved into an L shape and a support portion 16*b* that rotatably supports the drive arm member 16*a*. The drive arm member 16*a* is supported such that it is rotatable about the support portion 16*b* and is configured to be moved between a stopping position illustrated by the solid line in FIG. 7 and an ejection position illustrated by the imaginary line. Also, the drive arm member 16*a* is provided with a pilot valve portion 16*c* that opens and closes the pilot valve port 19*c* of the water supply control valve 19 as illustrated in FIG. 10. The pilot valve port 19*c* is closed by the pilot valve portion 16*c* when the drive arm member 16*a* is moved to the stopping position, and the pilot valve port 19*c* is opened when the drive arm member 16*a* is moved to the ejection position. Also, the pilot valve port 19*c* communicates with the pressure chamber 19*d* in the water supply valve main body portion 19*a* of the water supply control valve 19.

In other words, since the pilot valve port 19*c* is closed by the pilot valve portion 16*c* of the drive arm member 16*a* in a state in which the drive arm member 16*a* has been moved to the stopping position, the pressure in the pressure chamber 19*d* of the water supply control valve 19 increases, and the main valve body 19*b* of the water supply control valve 19 is closed. On the other hand, since the pilot valve port 19*c* is opened in a state in which the drive arm member 16*a* has been moved to the ejection position, the pressure in the pressure chamber 19*d* decreases, and the main valve body 19*b* opened. Also, the drive arm member 16*a* of the water supply valve driving mechanism 16 is moved from the stopping position to the ejection position by the user operating the lever handle 8 (FIG. 3). In this manner, the pilot valve port 19*c* is opened, the main valve body 19*b* of the water supply control valve 19 is opened, and water ejection from the rim spout port 2*d* is started. Note that the lever handle 8 and the drive arm member 16*a* are connected with a wire (not illustrated).

As illustrated in FIGS. 3 and 5, the biasing mechanism 17 includes a small tank 17*a* that is provided in the reservoir tank 10 and retains flush water, a biasing float 17*b* that is disposed in the small tank 17*a*, and a biasing rod 17*c* that extends upward from the biasing float 17*b*. The small tank 17*a* is a small tank provided inside the reservoir tank 10, and the small tank 17*a* is always kept in a full water state regardless of the water level in the reservoir tank 10. The biasing float 17*b* is a float disposed in a state in which it is submerged inside the small tank 17*a* and is configured to always receive a buoyant force from the flush water retained in the small tank 17*a* and generates a biasing force directed upward regardless of the water level in the reservoir tank 10. The biasing rod 17*c* is a rod-shaped member extending upward from an upper portion of the biasing float 17*b*, and the upper end portion of the biasing rod 17*c* is connected to one end portion of the drive arm member 16*a* of the water supply valve driving mechanism 16 as illustrated in FIG. 7. In this manner, the one end portion of the drive arm member 16*a* is biased upward, and as a result, the drive arm member 16*a* is biased to the stopping position thereof.

Note that in the present embodiment, the biasing mechanism 17 includes the small tank 17*a* and the biasing float 17*b* and generates a biasing force by the buoyant force acting on the biasing float 17*b*. In regard to this, it is also possible to configure the biasing mechanism 17 such that the biasing force is generated by an elastic member such as a coil spring in a modification example.

The holding mechanism 20 includes a holding mechanism main body portion 20*a*, an engaging member 20*b* that is attached to the holding mechanism main body portion 20*a*, and an engaged member 20*c* that is engaged with the engaging member 20*b* as illustrated in FIGS. 7 and 8. The holding mechanism main body portion 20*a* is attached to the upper end portion of the biasing rod 17*c* of the biasing mechanism 17 and is configured to move in the up-down direction along with the biasing rod 17*c*. The engaging member 20*b* is a member that is movably attached to the holding mechanism main body portion 20*a* and is moved between an engagement position (the section in (c) of FIG. 9) at which it projects toward the engaged member 20*c* and an engagement released position (the section in (e) of FIG. 9) at which it does not establish engagement with the engaged member 20*c*. Also, the engaging member 20*b* is biased toward the engagement position by a spring 20*d* (FIG. 9) that is an elastic member. Furthermore, a distal end of the engaging member 20*b* is provided with a sloped surface 20*e* that is sloped relative to the moving direction (up-down direction) of the holding mechanism main body portion 20*a*.

The engaged member 20*c* is a plate-shaped member fixed at a position where it faces the holding mechanism main body portion 20*a* and is provided with an opening 20*f* for receiving the engaging member 20*b*. When the drive arm member 16*a* is turned about the support portion 16*b* by the user operating the lever handle 8, then the biasing rod 17*c* and the holding mechanism main body portion 20*a* attached thereto are pushed downward as illustrated in the section (a) of FIG. 9. When the holding mechanism main body portion 20*a* is pushed downward, the sloped surface 20*e* of the engaging member 20*b* projecting from the holding mechanism main body portion 20*a* abuts on the upper end of the engaged member 20*c* disposed to face the holding mechanism main body portion 20*a*. When the holding mechanism main body portion 20*a* is further pushed downward, the sloped surface 20*e* of the engaging member 20*b* slides to the upper end of the engaged member 20*c*, and the distal end of the engaging member 20*b* moves backward to the side of the holding mechanism main body portion 20*a* as illustrated in the section (b) of FIG. 9. In other words, the engaging member 20*b* is moved from the engagement position to the engagement released position against the biasing force of the spring 20*d* by sliding to the engaged member 20*c*.

If the holding mechanism main body portion 20*a* is further pushed downward, and the drive arm member 16*a* is moved to the ejection position, the engaging member 20*b* is moved to a position at which it matches the opening 20*f* provided in the engaged member 20*c*. When the engaging member 20*b* matches the opening 20*f* of the engaged member 20*c*, then the engaging member 20*b* projects to the inside of the opening 20*f* of the engaged member 20*c* due to the biasing force of the spring 20*d* as illustrated in the section (c) of FIG. 9. In other words, the engaging member 20*b* is moved from the engagement released position to the engagement position, and engagement is established between the engaging member 20*b* and the engaged member 20*c*. In this state, the holding mechanism main body portion 20*a* is kept at the position against the biasing force generated by the biasing mechanism 17. In this manner, the drive arm member 16*a* is kept at the ejection position against the biasing force of the biasing mechanism 17.

Next, a configuration of the releasing mechanism 21 will be described.

As illustrated in FIG. 5, the releasing mechanism 21 includes a releasing arm member 21*a* formed substantially into a gate shape, a support portion 21*b* that rotatably supports the releasing arm member 21*a*, a water receiving portion 21*c* that is attached to one end portion of the releasing arm member 21*a*, a balance float 21*d* that is provided on the lower side of the water receiving portion 21*c*, and a connecting portion 21*e* (FIG. 3) that connects the water receiving portion 21*c* to the balance float 21*d*.

The releasing arm member 21*a* is supported such that the releasing arm member 21*a* is rotatable about the support portion 21*b* and is configured to be moved between a released position illustrated by the solid line in FIG. 8 and a non-released position illustrated by the imaginary line. Also, the pilot valve portion 21*f* of the releasing arm member 21*a* functions as a pilot valve that opens and closes the pilot valve port 18*c* of the discharge valve control valve 18 as illustrated in FIG. 11. The pilot valve port 18*c* communicates with the pressure chamber 18*d* in the control valve main body portion 18*a*. Therefore, when the releasing arm member 21*a* is moved to the released position, the pilot valve port 18*c* is opened, the pressure in the pressure chamber 18*d* of the discharge valve control valve 18 is thus lowered, and the main valve body 18*b* of the discharge valve control valve 18 is opened.

Also, as illustrated in FIG. 8, the releasing arm member 21*a* extends up to the rear side of the engaged member 20*c*, and a release end 21*g* of the releasing arm member 21*a* is located to face the engaging member 20*b* with the engaged member 20*c* sandwiched therebetween. Therefore, when the releasing arm member 21*a* is moved from the non-released position illustrated in the section (d) of FIG. 9 to the released position illustrated in the section (e) of FIG. 9, the distal end portion of the engaging member 20*b* received by the opening 20*f* of the engaged member 20*c* is pushed out by the release end 21*g* of the releasing arm member 21*a*. In this manner, the engagement between the engaging member 20*b* and the engaged member 20*c* is released.

On the other hand, the water receiving portion 21*c* is connected to the other end portion of the releasing arm member 21*a* as illustrated in FIG. 5.

The water receiving portion 21*c* is a cup-shaped member that opens on the upper side and is configured such that flush water that has been branched from the rim water supply pipe 25 by the branching portion 25*a* and has flowed to the downcomer 25*b* flows into the water receiving portion 21*c*. Also, the bottom portion of the water receiving portion 21*c* is provided with a discharge hole 21*h*, and the flush water that has flowed into the water receiving portion 21*c* is drained from the discharge hole 21*h* into the reservoir tank 10. Here, the flow rate of the flush water that flows from the downcomer 25*b* into the water receiving portion 21*c* is higher than the flow rate of the flush water that flows out from the discharge hole 21*h*, and in a state in which the flush water flows in from the downcomer 25*b*, the water level of the flush water in the water receiving portion 21*c* increases.

The balance float 21*d* is a float attached to a lower side of the water receiving portion 21*c* via the connecting portion 21*e*. The balance float 21*d* is configured to receive a buoyant force from the flush water retained in the reservoir tank 10 and push the water receiving portion 21*c* upward. In a case in which the flush water is not retained in the water receiving portion 21*c*, the water receiving portion 21*c* is brought into a state in which the balance float 21*d* is pushed upward by the buoyant force. In this state, the releasing arm member 21*a* connected to the water receiving portion 21*c* has been moved to the non-released position.

On the other hand, when the flush water flows from the downcomer 25*b* into the water receiving portion 21*c*, the weight of the water receiving portion 21*c* increases, and the balance float 21*d* is pushed downward by the water receiving portion 21*c*. When the weight of the water receiving portion 21*c* increases and overcomes the buoyant force acting on the balance float 21*d* due to the flush water flowing into the water receiving portion 21*c*, then the releasing arm member 21*a* is moved to the released position. When the releasing arm member 21*a* is moved to the released position, the pilot valve port 18*c* is opened, and the main valve body 18*b* of the discharge valve control valve 18 is thus opened.

Note that since the water receiving portion 21*c* is connected to the upper side of the balance float 21*d* via the connecting portion 21*e*, the water receiving portion 21*c* is still located above the stopped water level $L_1$ in the reservoir tank 10 even in a state in which the flush water has flowed in and the position of the water receiving portion 21*c* has been lowered. Therefore, the water receiving portion 21*c* itself does not receive the buoyant force from the flush water in the reservoir tank 10, and the water receiving portion 21*c* can effectively push the balance float 21*d* downward by the flush water flowing thereinto.

Next, newly referring to FIG. 12, effects of the flush water tank device 4 according to the embodiment of the present invention and a flush toilet apparatus 1 provided with the same will be described.

Figure 12:
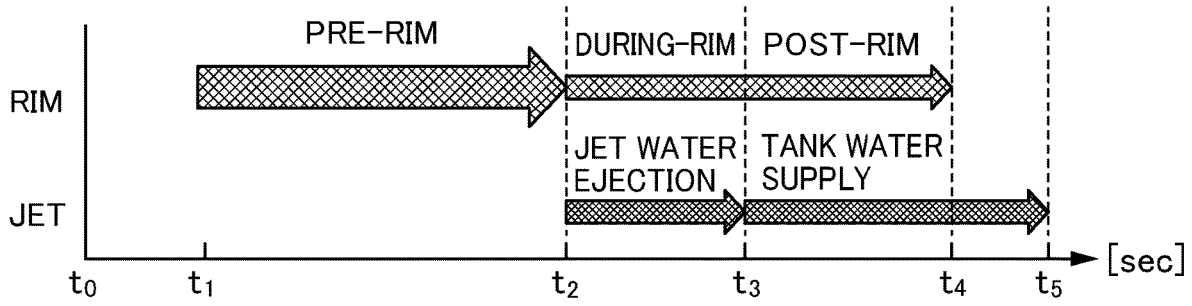
FIG. 12 is a time chart illustrating an example of a washing sequence performed by the flush water tank device according to the embodiment of the present invention.

FIG. 12 is a time chart illustrating an example of a washing sequence performed by the flush water tank device 4 according to the embodiment of the present invention.

First, in a toilet washing standby state at a clock time $t_0$ in FIG. 12, the water level in the reservoir tank 10 is at the stopped water level $L_1$. In this state, the drive arm member 16*a* of the water supply valve driving mechanism 16 is at the stopping position, the releasing arm member 21*a* of the releasing mechanism 21 is at the non-released position, and thus, each of the pilot valve port 19*c* of the water supply control valve 19 and the pilot valve port 18*c* of the discharge valve control valve 18 is closed. Therefore, the main valve body 19*b* of the water supply control valve 19 is in the valve closed state, and the main valve body 18*b* of the discharge valve control valve 18 is also in the valve closed state.

Next, when the user operates the lever handle 8 (FIG. 1) at a clock time $t_1$ in FIG. 12, the drive arm member 16*a* of the water supply valve driving mechanism 16 is moved to the ejection position in conjunction with the operation. The holding mechanism main body portion 20*a* of the holding mechanism 20 connected to the drive arm member 16*a* and the biasing rod 17*c* of the biasing mechanism 17 are also pushed downward by the drive arm member 16*a* being moved to the ejection position. Also, the sloped surface 20*e* at the distal end of the engaging member 20*b* of the holding mechanism 20 abuts on the upper end of the engaged member 20*c* when the holding member main body portion 20*a* is pushed downward, and the engaging member 20*b* moves backward to the engagement released position (see the section (b) of FIG. 9). Furthermore, when the drive arm member 16*a* is moved to the ejection position, the engaging member 20*b* matches the opening 20*f* of the engaged member 20*c*, and the engaging member 20*b* projects to the inside of the opening 20*f* (see the section (c) of FIG. 9). In this manner, engagement is established between the engaging member 20*b* and the engaged member 20*c*.

On the other hand, the biasing mechanism 17 biases the holding mechanism main body portion 20*a* upward using the buoyant force acting on the biasing float 17*b*, and the holding mechanism main body portion 20*a* is kept at the pushed-down position through the engagement of the engaging member 20*b* with the engaged member 20*c*. In this manner, the holding mechanism 20 holds the drive arm member 16*a* of the water supply valve driving mechanism 16 that has been moved to the ejection position at the ejection position against the biasing force of the biasing mechanism 17 by the engaging member 20*b* establishing engagement with the engaged member 20*c*.

If the drive arm member 16*a* of the water supply valve driving mechanism 16 is moved to the ejection position, the pilot valve port 19*c* (FIG. 10) of the water supply control valve 19 is opened. In this manner, the pressure in the pressure chamber 19*d* inside the water supply valve main body portion 19*a* decreases, and the main valve body 19*b* is separated from a valve seat and is opened. When the water supply control valve 19 is opened, the tap water supplied from the water supply pipe 32 to the water supply control valve 19 via the water supply pipe branching portion 33 and the second branching pipe 33*b* flows into the rim water supply pipe 25 through the water supply control valve 19. The flush water that has flowed into the rim water supply pipe 25 is ejected from the rim spout port 2*d* (FIG. 2) of the flush toilet main body 2 and is used as "pre-rim" ejected water before water ejection from the jet spout port 2*b* is started, and washing of the bowl 2*a* is started with rim flush water. Also, a part of the flush water that has flowed into the rim water supply pipe 25 flows into the downcomer 25*b* (FIG. 5), and the flush water that has flowed into the downcomer 25*b* flows into the water receiving portion 21*c* of the releasing mechanism 21 disposed below the downcomer 25*b*. In other words, the flush water that has flowed out from the water supply control valve 19 is branched and supplied to each of the rim spout port 2*d* and the water receiving portion 21*c* of the releasing mechanism 21.

If the amount of flush water that has flowed in from the downcomer 25*b* and has been retained in the water receiving portion 21*c* exceeds a predetermined amount at a clock time $t_2$ in FIG. 12 after water ejection from the rim spout port 2*d* is started, the gravity working on the water receiving portion 21*c* overcomes the buoyant force acting on the balance float 21*d*, and the water receiving portion 21*c* is lowered. When the water receiving portion 21*c* is lowered, the releasing arm member 21*a* connected thereto is turned about the support portion 21*b*, and the releasing arm member 21*a* is moved from the non-released position to the released position. When the releasing arm member 21*a* is moved to the released position, the pilot valve port 18*c* (FIG. 11) of the discharge valve control valve 18 is opened, the pressure in the pressure chamber 18*d* inside the control valve main body portion 18*a* thus decreases, and the main valve body 18*b* is opened. In other words, the discharge valve control valve 18 is opened with the water supply control valve 19 maintained in the valve opened state after the water supply control valve 19 is opened. Also, when the releasing arm member 21*a* is moved to the released position, the holding of the drive arm member 16*a* achieved by the holding mechanism 20 is also released as will be described later.

If the discharge valve control valve 18 is opened, the tap water supplied from the water supply pipe 32 to the discharge valve control valve 18 via the water supply pipe branching portion 33 and the first branching pipe 33*a* flows into the inlet pipe 23 (FIG. 5) through the discharge valve control valve 18. Furthermore, the flush water that has flowed into the inlet pipe 23 flows into the cylinder 14*a* of the discharge valve water pressure drive portion 14 and pushes the piston 14*b* (FIG. 4) upward. In this manner, the rod 15 connected to the piston 14*b* and the discharge valve 12 are also pulled upward, and the drain port 10*a* is opened. In other words, the discharge valve control valve 18 is a control valve for causing the discharge valve 12 to open.

The flush water retained in the reservoir tank 10 flows out through the drain port 10*a* by the drain port 10*a* being opened and is ejected as "jet ejected water" from the jet spout port 2*b* (FIG. 2) provided at the lower portion of the bowl 2*a*. The flush water ejected from the jet spout port 2*b* completely fills the water discharge trap pipe 2*e* extending from the lower portion of the bowl 2*a* and induces a siphon phenomenon. Through the siphon phenomenon, the retained water and solid waste in the bowl 2*a* are discharged through the water discharge trap pipe 2*e*. In this manner, the water ejection from the rim spout port 2*d* is continued as "during-rim" water ejection even when the flush water is being ejected from the jet spout port 2*b*. Therefore, the flush water is temporarily ejected from both the rim spout port 2*d* and the jet spout port 2*b* by the drain port 10*a* being opened.

In this manner, in the flush toilet apparatus 1 according to the present embodiment, the supply of the flush water from the rim spout port 2*d* is continued even during occurrence of the siphon phenomenon by the flush water drained from the jet spout port 2*b*. Therefore, it is possible to prevent an excessive decrease in retained water in the bowl 2*a* due to retained water drawing in through the siphon phenomenon, which leads to interruption of sealed water in the water discharge trap pipe 2*e*. When the sealed water in the water discharge trap pipe 2*e* is interrupted, there is a concern that odor flows backward from the water discharge trap pipe 2*e*. However, it is possible to prevent this in the present embodiment. Also, since the supply of the flush water from the rim spout port 2*d* is continued even during occurrence of the siphon phenomenon, the sealed water is not interrupted, and it is possible to continue the siphon phenomenon and thereby to prevent the siphon phenomenon from ending in the process.

On the other hand, when the piston 14*b* is pushed upward by the discharge valve water pressure drive portion 14, and in response with this, the rod 15 and the discharge valve 12 are pulled upward to predetermined positions, then the clutch mechanism 22 separates the lower rod 15*b* and the discharge valve 12 from the upper rod 15*a*. In this manner, the upper rod 15*a* is maintained to be pushed upward along with the piston 14*b* when the discharge valve control valve 18 is opened, while the lower rod 15*b* and the discharge valve 12 are lowered due to their own weights. However, the separated lower rod 15*b* establishes engagement with the engaging portion 26*b* of the discharge valve float mechanism 26, and lowering of the lower rod 15*b* and the discharge valve 12 are prevented. In this manner, the drain port 10*a* of the reservoir tank 10 is maintained to be opened even after the clutch mechanism 22 is separated, and water discharge from the reservoir tank 10 is continued.

Also, when the flush water flows from the inlet pipe 23 into the cylinder 14*a* of the discharge valve water pressure drive portion 14, and the piston 14*b* is pushed upward to the upper portion of the cylinder 14*a*, the flush water in the cylinder 14*a* flows out through the outlet pipe 24 (FIG. 5). Also, a part of water that has flowed from the inlet pipe 23 into the cylinder 14*a* flows out from the clearance 14*d* (FIG. 4) between the inner wall of the through-hole 14*f* of the cylinder 14*a* and the rod 15, and the water flows into the reservoir tank 10. On the other hand, a part of the flush water that has flowed out through the outlet pipe 24 flows into the overflow pipe 10*b*, and remaining flush water flows into the reservoir tank 10. In other words, a part of the flush water that has flowed out of the discharge valve water pressure drive portion 14 flows into the reservoir tank 10, and the remaining flush water that has flowed into the overflow pipe 10*b* bypasses the discharge valve 12 and flows from the jet spout port 2*b* into the flush toilet main body. Note that since the flow rate of the flush water flowing into the reservoir tank 10 through the outlet pipe 24 is lower than the flow rate of the flush water drained from the drain port 10*a* by the discharge valve 12 being opened, the water level in the reservoir tank 10 is lowered in this state.

On the other hand, when the releasing arm member 21*a* is moved to the released position, the release end 21*g* (FIG. 8) of the releasing arm member 21*a* pushes back (the section (d) to the section (e) of FIG. 9) the engaging member 20*b* that faces the release end 21*g* with the engaged member 20*c* of the holding member 20 sandwiched therebetween and releases the engagement between the engaging member 20*b* and the engaged member 20*c*. When the engagement between the engaging member 20*b* and the engaged member 20*c* is released, the holding mechanism main body portion 20*a* of the holding mechanism 20 is moved upward by the biasing force of the biasing mechanism 17. In other words, the biasing float 17*b* of the biasing mechanism 17 receives the buoyant force from the flush water retained in the small tank 17*a* and causes the biasing rod 17*c* attached to the biasing float 17*b* to move upward. In this manner, the holding mechanism main body portion 20*a* and the drive arm member 16*a* connected to the biasing rod 17*c* are moved. In this manner, the releasing mechanism 21 releases the holding state of the drive arm member 16*a* of the water supply valve driving mechanism 16 using the weight of the flush water that has flowed out from the water supply control valve 19 and have been retained in the water receiving portion 21*c*. In other words, the releasing mechanism 21 releases the holding of the drive arm member 16*a* on the basis of the amount of the flush water that has flowed out from the water supply control valve 19. In this manner, the drive arm member 16*a* of the water supply valve driving mechanism 16 starts to move from the ejection position to the stopping position. Also, the biasing force of the biasing mechanism 17 is relatively weak, and the biasing rod 17*c* slightly moves upward after the engagement between the engaging member 20*b* and the engaged member 20*c* is released.

Then, when the water level in the reservoir tank 10 is lowered to a predetermined water level by the flush water in the reservoir tank 10 being drained from the drain port 10*a*, the float portion 26*a* of the discharge valve float mechanism 26 is lowered, and this causes the engaging portion 26*b* to move. In this manner, the engagement between the lower rod 15*b* and the engaging portion 26*b* is released, and the lower rod 15*b* and the discharge valve 12 start to move downward again. Then, the drain port 10*a* of the reservoir tank 10 is closed by the discharge valve 12 at a clock time $t_3$ in FIG. 12, and the water ejection of the flush water, which has flowed out from the drain port 10*a*, from the jet spout port 2*b* is stopped.

Furthermore, since the discharge valve control valve 18 is in the valve opened state even after the drain port 10*a* is closed, the water supplied from the water supply pipe 32 flows into the discharge valve water pressure drive portion 14 and flows out to the outlet pipe 24 (FIG. 5). Since a most part of the flush water that has flowed out from the outlet pipe 24 flows into the reservoir tank 10 through the second downcomer 24*c*, the water level in the reservoir tank 10 increases. Also, a part of the remaining flush water that has flowed out from the outlet pipe 24 flows into the overflow pipe 10*b* through the first downcomer 24*b*. Therefore, the flush water that has flowed into the overflow pipe 10*b* flows into the bowl 2*a* through the jet spout port 2*h* at a low flow rate even after the drain port 10*a* is closed, and the flush water that has flowed into the bowl 2*a* is used as refill water.

Furthermore, the drive arm member 16*a* of the water supply valve driving mechanism 16 that has been moved by the biasing rod 17*c* of the biasing mechanism 17 reaches the stopping position at a clock time $t_4$ after the water ejection from the jet spout port 2*b* is stopped at the clock time $t_3$ in FIG. 12. The pilot valve port 19*c* (FIG. 10) of the water supply control valve 19 is closed by the drive arm member 16*a* reaching the stopping position. In this manner, the main valve body 19*b* of the water supply control valve 19 is closed, and the water ejection from the rim spout port 2*d* of the flush toilet main body 2 is stopped. Note that after the jet water ejection is ended, water ejection from the rim spout port 2*d* is performed as "post-rim" water ejection, and the flush water ejected from the rim spout port 2*d* also flows into the bowl 2*a* and is used as refill water. Also, the discharge valve control valve 18 is maintained in the valve opened state even after the water supply control valve 19 is closed, and the flush water that has flowed from the first downcomer 24*b* into the overflow pipe 10*b* through the discharge valve water pressure drive portion 14 is used as a refill for the bowl 2*a*.

Note that in the present embodiment, a part of the remaining flush water that has flowed out from the outlet pipe 24 flows into the overflow pipe 10*b* through the first downcomer 24*b*, and this is used as a refill for the bowl 2*a*. In this regard, it is also possible to adjust water ejection time from the rim spout port 2*d* of the flush toilet main body 2, for example, and to use the flush water ejected from the rim spout port 2*d* after the jet water ejection is ended as a refill for the bowl 2*a* in a modification example.

On the other hand, when the water supply control valve 19 is closed, the flush water flowing into the water receiving portion 21*c* of the releasing mechanism 21 through the downcomer 25*b* branched from the rim water supply pipe 25 (FIG. 5) is also stopped. Also, the water receiving portion 21*c* is provided with the discharge hole 21*h* (FIG. 5) as described above, and the flush water that has flowed into the water receiving portion 21*c* is drained from the discharge hole 21*h* into the reservoir tank 10. Therefore, of the flowing-in when the flush water from the downcomer 25*b* is stopped, the amount of flush water retained in the water receiving portion 21*c* decreases little by little.

If the amount of flush water in the water receiving portion 21*c* decreases to a predetermined amount at a clock time $t_5$ in FIG. 12, the water receiving portion 21*c* moves upward due to the buoyant force acting on the balance float 21*d*. In this manner, the releasing arm member 21*a* (FIG. 5) connected to the water receiving portion 21*c* is turned about the support portion 21*b* from the released position to the non-released position. When the releasing arm member 21*a* is moved to the non-released position, the pilot valve port 18*c* (FIG. 11) of the discharge valve control valve 18 is closed. In this manner, the pressure in the pressure chamber 18*d* inside the control valve main body portion 18*a* increases, the main valve body 18*b* is closed, and the discharge valve control valve 18 is brought into a valve closed state. As described above, the water supply to the reservoir tank 10 is stopped. Also, the water level in the reservoir tank 10 at this time is the stopped water level $L_1$.

On the other hand, when the supply of water to the discharge valve water pressure drive portion 14 is stopped by the discharge valve control valve 18 being closed, the piston 14*b* (FIG. 4) of the discharge valve water pressure drive portion 14 is pushed downward by the biasing force of the spring 14*c*. When the upper rod 15*a* is pushed downward along with the piston 14*b*, the upper rod 15*a* and the lower rod 15*b* that have been separated by the clutch mechanism 22 are connected to each other again. Therefore, both the upper rod 15*a* and the lower rod 15*b* are pulled upward by the piston 14*b* when the toilet washing is executed next time. As described above, one-time toilet washing is ended, and the flush toilet apparatus 1 returns to the toilet washing standby state.

According to the flush water tank device 4 in the embodiment of the present invention, the holding state of the water supply valve driving mechanism 16 is released using flush water supplied from the water supply source such as tap water C and flowing out from the water supply control valve 19 that is a first on-off valve, the water supply valve driving mechanism 16 is moved to the stopped position, and it is thus possible to reliably cause water ejection from the rim spout port 2*d* to stop at an accurate timing without being affected by the water level in the reservoir tank 10. Also, since the water supply valve driving mechanism 16 is biased by the bias force of the biasing mechanism 17, the bias force is stable without being affected by the water level in the reservoir tank 10, and it is possible to prevent the water supply valve driving mechanism 16 from accidentally moved and to cause the water supply valve driving mechanism 16 to reliably operate.

Also, according to the flush water tank device 4 of the present embodiment, the releasing mechanism 21 causes the holding of the water supply valve driving mechanism 16 to be released on the basis of the amount of flush water flowing out from the water supply control valve 19, and it is thus possible to accurately set a time during which the first on-off valve is opened and to finely control the amount of flush water ejected from the upper spout port.

Furthermore, according to the flush water tank device 4 of the present embodiment, the flush water flowing out from the water supply control valve 19 is branched and supplied to each of the rim spout port 2*d* and the water receiving portion 21*c* of the releasing mechanism 21, and it is thus possible to use the flush water supplied from the water supply source and flowing out from the water supply control valve 19 both for washing the flush toilet and for operating the releasing mechanism 21.

Also according to the flush water tank device 4 of the present embodiment, the holding of the water supply valve driving mechanism 16 is released depending on the amount of flush water supplied from the water supply control valve 19 and retained in the water receiving portion 21*c*, and it is thus possible to release the holding achieved by the holding mechanism 20 on the basis of the amount of flush water with a simple mechanism.

Moreover, according to the flush water tank device 4 of the present embodiment, the releasing mechanism 21 causes the holding of the water supply valve driving mechanism 16 to be released and causes the discharge valve control valve 18 which is a second on-off valve to be opened when the flush water retained in the water receiving portion 21*c* exceeds the predetermined amount, and it is thus possible to control the discharge valve 12 as well using the flush water flowing out from the water supply control valve 19.

Also, according to the flush water tank device 4 of the present embodiment, the discharge valve water pressure drive portion 14 which is a water pressure driving mechanism that opens and closes the discharge valve 12 is included, and it is thus possible to cause the discharge valve 12 to be opened even with a relatively small amount of flush water flowing out from the discharge valve control valve 18.

Furthermore, according to the flush water tank device 4 of the present embodiment, the bias force of the biasing mechanism 17 is caused by the buoyant force acting on the biasing float 17*b*, and it is thus possible to reliably cause the bias force with a simple mechanism. Also, since the biasing float 17*b* is disposed in the small tank 17*a*, it is possible to cause stable bias force regardless of the water level in the reservoir tank 10.

Also, according to the flush water tank device 4 of the present embodiment, the holding mechanism 20 holds the water supply valve driving mechanism 16 at the ejection position by the engaging member 20*b* being engaged with the engaged member 20*c*, and it is thus possible to reliably hold the water supply valve driving mechanism 16 at the ejection position with a simple mechanism.

Moreover, according to the flush water tank device 4 of the present embodiment, the engaging member 20*b* is biased by the spring 20*d* which is an elastic member toward the engagement position, and it is thus possible to cause the engaging member 20*b* to move to the engagement position with a simple mechanism and to cause the holding mechanism 20 to reliably operate.

Also, according to the flush water tank device 4 of the present embodiment, the engaging member 20*b* is moved toward the engagement released position by the sloped surface 20*e* of the engaging member 20*b* sliding along the engaged member 20*c*, and it is thus possible to reliably cause the engaging member 20*b* to move with a simple mechanism on the basis of an operation of the user.

Although the embodiments of the present invention have been described hitherto, various modifications can be added to the aforementioned embodiments. For example, although the rim spout port 2*d* that causes the flush water to be ejected along the wall surface of the rim 2*c* at the upper end of the bowl 2*a* is provided as the upper spout port in the aforementioned embodiments, it is possible to use, as the upper spout port, various spout ports provided above the retained water surface W of the flush toilet main body 2. Moreover, although the jet spout port 2*b* provided at the bottom portion of the bowl 2*a* to face the inlet of the water discharge trap pipe 2*e* is provided at the lower spout port in the aforementioned embodiments, it is possible to use, as the lower spout port, various spot ports provided below the retained water surface W of the flush toilet main body 2.

REFERENCE SIGNS LIST

1 Flush toilet apparatus
2 Flush toilet main body
2*a* Bowl
2*b* Jet spout port (lower spout, port)
2*c* Rim
2*d* Rim spout port (upper spout port)
2*e* Water discharge trap pipe
4 Flush water tank device
8 Lever handle
10 Reservoir tank (flush water tank main body)
10*a* Drain port
10*b* Overflow pipe
12 Discharge valve
14 Discharge valve water pressure drive portion (water pressure driving mechanism)

14*a* Cylinder
14*b* Piston
14*c* Spring
14*d* Clearance
14*e* Packing
14*f* Through-hole
14*g* Frame
15 Rod
15*a* Upper rod
15*b* Lower rod
16 Water supply valve driving mechanism (first on-off valve driving mechanism)
16*a* Drive arm member
16*b* Support portion
16*c* Pilot valve portion
17 Biasing mechanism
17*a* Small tank
17*b* Biasing float
17*c* Biasing rod
18 Discharge valve control valve (second on-off valve)
18*a* Control valve main body portion
18*b* Main valve body
18*c* Pilot valve port
18*d* Pressure chamber
19 Water supply control valve (first on-off valve)
19*a* Water supply valve main body portion
19*b* Main valve body
19*c* Pilot valve port
19*d* Pressure chamber
20 Holding mechanism
20*a* Holding mechanism main body portion
20*b* Engaging member
20*c* Engaged member
20*d* Spring
20*e* Sloped surface
20*f* Opening
21 Releasing mechanism
21*a* Releasing arm member
21*b* Support portion
21*c* Water receiving portion
21*d* Balance float
21*e* Connecting portion
21*f* Pilot valve portion
21*g* Release end
21*h* Discharge hole
22 Clutch mechanism
23 Inlet pipe
24 Outlet pipe
24*a* Branching portion
24*b* First downcomer
24*c* Second downcomer
25 Rim water supply pipe
25*a* Branching portion
25*b* Downcomer
26 Discharge valve float mechanism
26*a* Float portion
26*b* Engaging portion
30*a* Fixed flow valve
30*b* Vacuum breaker
31 Vacuum breaker
32 Water supply pipe
32*a* Stop cock
32*b* Fixed flow valve
33 Water supply pipe branching portion
33*a* First branching pipe
33*b* Second branching pipe

What is claimed is:

1. A flush water tank device for supplying flush water to an upper spout port above a retained water surface in a flush toilet main body and a lower spout port below the retained water surface, the flush water tank device comprising:

a flush water tank main body;

a discharge valve that causes the flush water retained in the flush water tank main body to be drained and causes the flush water to be ejected from the lower spout port on the basis of an operation of a user;

a first on-off valve for performing switching between an ejection state from the upper spout port and an ejection stopped state of the flush water supplied from a water supply source;

a first on-off valve driving mechanism that is moved from a stopped position at which the first on-off valve is brought into the ejection stopped state to an ejection position at which the first on-off valve is brought into the ejection state on the basis of the operation of the user;

a biasing mechanism that causes a bias force such that the first on-off valve driving mechanism is moved to the stopped position;

a holding mechanism that holds the first on-off valve driving mechanism which has been moved to the ejection position at the ejection position against the bias force caused by the biasing mechanism; and a releasing mechanism that releases the holding of the first on-off valve driving mechanism achieved by the holding mechanism, using the flush water flowing out from the first on-off valve.

2. The flush water tank device according to claim 1, wherein the releasing mechanism causes the holding of the first on-off valve driving mechanism to be released and causes the first on-off valve driving mechanism to move to the stopped position on the basis of an amount of the flush water flowing out from the first on-off valve.

3. The flush water tank device according to claim 2, wherein the flush water flowing out from the first on-off valve is branched and supplied to each of the upper spout port and the releasing mechanism.

4. The flush water tank device according to claim 3, wherein the releasing mechanism includes a water receiving portion into which the flush water supplied from the first on-off valve flows and causes the holding of the first on-off valve driving mechanism achieved by the holding mechanism to be released when the flush water retained in the water receiving portion exceeds a predetermined amount.

5. The flush water tank device according to claim 4, further comprising:

a second on-off valve for causing the discharge valve to open, wherein the releasing mechanism causes the holding of the first on-off valve driving mechanism to be released and causes the second on-off valve to open when the flush water retained in the water receiving portion exceeds the predetermined amount.

6. The flush water tank device according to claim 5, further comprising:

a water pressure driving mechanism that causes the discharge valve to open and close, wherein the water pressure driving mechanism causes the discharge valve to open by a water pressure of the flush water supplied via the second on-off valve.

7. The flush water tank device according to claim 1, wherein the biasing mechanism includes a small tank that is provided inside the flush water tank main body and retains the flush water and a biasing float that is disposed inside the small tank, and the biasing mechanism uses a buoyant force acting on the biasing float to generate the bias force.

8. The flush water tank device according to claim 1, wherein the holding mechanism includes an engaging member and an engaged member that is engaged with the engaging member, and the first on-off valve driving mechanism is held at the ejection position by the engaging member engaging with the engaged member.

9. The flush water tank device according to claim 8, wherein the engaging member is provided such that the engaging member is movable between an engagement position and an engagement released position, and the engaging member is biased by an elastic member toward the engagement position.

10. The flush water tank device according to claim 9, wherein the engaging member includes a sloped surface, and when the first on-off valve driving mechanism is moved to the ejection position based on the operation of the user, the engaging member is moved toward the engagement released position against a bias force of the elastic member by the sloped surface sliding along the engaged member.

11. A flush toilet apparatus comprising:

a flush toilet main body that includes an upper spout port above a retained water surface and a lower spout port below the retained water surface; and the flush water tank device according to claim 1 that supplies the flush water to the upper spout port and the lower spout port.

* * * * *